US007330672B2

(12) United States Patent
Takahashi et al.

(10) Patent No.: US 7,330,672 B2
(45) Date of Patent: Feb. 12, 2008

(54) IMAGE FORMING APPARATUS ABLE TO EXECUTE SELECTED OPERATING MODE UPON REPLACEMENT OF REPLACEABLE UNIT, AND METHOD THEREFORE

(75) Inventors: Atsushi Takahashi, Saitama (JP); Haruhiko Okabe, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 20 days.

(21) Appl. No.: 11/082,971

(22) Filed: Mar. 18, 2005

(65) Prior Publication Data

US 2006/0051106 A1 Mar. 9, 2006

(30) Foreign Application Priority Data

May 17, 2004 (JP) ..... 2004-146151
May 17, 2004 (JP) ..... 2004-146154

(51) Int. Cl.
*G03G 15/00* (2006.01)

(52) U.S. Cl. ..... 399/12

(58) Field of Classification Search ..... 399/12, 399/258, 260, 24, 25, 82, 85
See application file for complete search history.

(56) References Cited

U.S. PATENT DOCUMENTS 5,835,817 A * 11/1998 Bullock et al. ..... 399/25
6,212,338 B1 * 4/2001 Hagihara et al. ..... 399/12
6,647,213 B2 * 11/2003 Takeda ..... 399/12
7,050,726 B2 * 5/2006 Adkins et al. ..... 399/12
2005/0254837 A1 * 11/2005 Takahashi ..... 399/12
2005/0254839 A1 * 11/2005 Nagamine et al. ..... 399/12
2005/0254840 A1 * 11/2005 Saisu et al. ..... 399/12

FOREIGN PATENT DOCUMENTS

JP A 6-149051 5/1994
JP B2 2602341 1/1997
JP A 10-133528 5/1998
JP A 2001-100598 4/2001
JP B2 3476704 9/2003

* cited by examiner

*Primary Examiner*—Quana Grainger
(74) *Attorney, Agent, or Firm*—Oliff & Berridge, PLC

(57) ABSTRACT

When a CPU receives an input signal that selects an operation mode through an operation mode selecting screen, the CPU determines whether or not the selected operation mode coincides with an operation mode stored in individual operation mode histories of an main body NVM. If both the operation modes do not coincide with each other, the CPU starts counting of a midway consumption of a toner representing the consumption of the toner used thereafter. Further, the CPU determines whether or not the count of the midway consumption arrives at a specified value. If the count arrives at the specified value, the CPU updates the individual operation mode histories of the main body NVM with the selected operation mode, and switches an existing operation mode to the selected operation mode.

14 Claims, 31 Drawing Sheets

IMAGE FORMING APPARATUS ABLE TO EXECUTE SELECTED OPERATING MODE UPON REPLACEMENT OF REPLACEABLE UNIT, AND METHOD THEREFORE

BACKGROUND OF THE INVENTION

1. Field of the Invention

The present invention relates to an image forming apparatus mounted with replaceable units, an image forming system, and a method of controlling the image forming apparatus, and more specifically, to an image forming apparatus in which the replaceable units are replaceably mounted in an image forming apparatus main body.

2. Background Art

An image forming apparatus which allows a user to easily replace a unit including consumables and the like is known.

Meanwhile, if a replaceable unit replaced by a user is not a genuine article for an image forming apparatus, there are problems in that the performance of the image forming apparatus cannot be sufficiently exhibited, like deterioration of the image quality, the operation of the apparatus cannot be guaranteed, or the apparatus can get out of order. This is because the image forming apparatus controls processes for forming an image in consideration of characteristics of a toner, characteristics of an image carrier, an electrification voltage, cleaning characteristics, fixing characteristics and the like.

Therefore, in order to maintain the image quality of an image forming apparatus, and to prevent occurrence of the above problems, JP-A-10-133528 discloses a method which comprises providing a genuine replaceable part with a data carrier for holding consumption data on consumables, and discriminating whether the genuine replaceable unit has been supplied with the consumables by comparing a consumption detected by a consumption detecting unit provided in an image forming apparatus main body with the consumption data held by the data carrier.

Further, JP-A-6-149051 discloses a method which comprises providing a toner cartridge with a storage unit for storing predetermined coded data, and inhibiting copying when the predetermined coded data stored in the storage unit has not yet been read from the copying machine main body side.

Further, JP-A-2001-100598 discloses a method which comprises performing warning display and printing inhibition when empty information to be written in a cartridge at the time of detection of run-out of a toner is read from a cartridge refilled with a toner.

Further, Japanese Patent No. 2602341 discloses a method which comprises making the count of the images formed and storing it in a memory of a cartridge, and, if a preset final count representing the number of images capable of being formed by a cartridge is equal to the count of images which are actually formed, disabling the cartridge from being used afterwards.

Moreover, Japanese Patent No. 3476704 discloses a method which comprises setting an image forming condition whose level is lowered than that of an appropriate image forming condition, thereby allowing a user to easily find the fact that a mounted toner refilling container is inappropriate, when it is determined that the toner refilling container is inappropriate through duplex communication between a communication unit of the toner refilling container side and a communication unit of an apparatus main body side, and a selective input unit selects the fact that the user continues to refill a toner while inappropriateness of the container is ignored.

SUMMARY OF THE INVENTION

A first object of the present invention is to provide an image forming apparatus, an image forming system, and a method of controlling the image forming apparatus, which can use a replaceable unit other than a genuine article, by a user's intention, even when the replaceable unit other than a genuine article is mounted. Further, a second object of the present invention is to provide an image forming apparatus, which can reduce bad effects caused by a state before a replaceable unit has been replaced, when the replaceable unit has been replaced. Further, a third object of the present invention is to discriminate whether or not a replaceable unit is genuine or not, thereby helping a user to select an operation mode suitable for the replaceable unit.

In order to achieve the above-mentioned objects, according to a first aspect of the invention, there is provided an image forming apparatus including: an image forming apparatus main body; at least one replaceable unit replaceably mounted in the image forming apparatus main body; a detecting unit that detects whether or not the replaceable unit has been replaced; an input unit for selecting a first operation mode corresponding to the replaceable unit which is genuine or a second operation mode other than the first operation mode; a control unit that performs control in an operation mode selected by the input unit, wherein, when the detecting unit detects that the replaceable unit has been replaced, the control unit controls the image forming apparatus to operate in an operation mode before the replacement of the replaceable unit, for a predetermined period of time from the time when the replaceable unit has been replaced. That is, when a replaceable unit has been replaced, even if a state before the replaceable unit has been replaced lasts for a predetermined period of time, the control unit controls the image forming apparatus to operate in an operation mode before other operation mode is selected, for a predetermined period of time from the time when the replaceable unit has been replaced. Therefore, it is possible to reduce bad effects caused by a state before a replaceable unit has been replaced.

In addition, the operation mode mentioned herein means aspects of control of an image forming apparatus, and includes not only programs and control parameters for forming an image, but also input and output conditions, and further includes aspects of display onto a display device, which are not directly related to the image formation.

According to a second aspect of the invention, there is provided an image forming apparatus including: an image forming apparatus main body; at least one replaceable unit replaceably mounted in the image forming apparatus main body; a detecting unit that detects whether or not the replaceable unit has been replaced; a discriminating unit that discriminates whether or not the replaceable unit is genuine; an input unit for selecting a first operation mode corresponding to the replaceable unit which is genuine or a second operation mode other than the first operation mode; and a control unit that performs control in an operation mode selected by the input unit, wherein, when the detecting unit detects that the replaceable unit has been replaced, the control unit controls the image forming apparatus to operate in an operation mode before the replacement of the replaceable unit, for a predetermined period of time from the time when the replaceable unit has been replaced, on the basis of discrimination results of the discriminating unit. That is, when a replaceable unit has been replaced with a genuine article or any one other than a genuine article, even if a state before the replaceable unit has been replaced lasts for a predetermined period of time, the control unit controls the image forming apparatus to operate in an operation mode before other operation mode is selected, for a predetermined period of time from the time when the replaceable unit has been replaced. Therefore, it is possible to reduce bad effects caused by a state before a replaceable unit is replaced.

Preferably, the image forming apparatus further comprises a storage unit that stores an applied operation mode, and when the detecting unit detects that the replaceable unit has been replaced, the discriminating unit discriminates that the replaceable unit is not genuine, and an operation mode selected by the input unit is different from the operation mode stored in the storage unit, the control unit controls the image forming apparatus to operate in the first operation mode for the predetermined period of time from the time when the replaceable unit has been replaced. That is, when a replaceable unit is not genuine and an operation mode is switched to other operation mode, the control unit controls the image forming apparatus to operate in the first mode for a predetermined period of time from the time when the replaceable unit has been replaced. Therefore, it is possible to reduce bad effects caused by a state before a replaceable unit is replaced.

Further, preferably, the image forming apparatus further comprises a storage unit that stores an applied operation mode, and when the detecting unit detects that the replaceable unit has been replaced, the discriminating unit discriminates that the replaceable unit is genuine, and an operation mode selected by the input unit is different from the operation mode stored in the storage unit, the control unit controls the image forming apparatus to operate in the second operation mode for the predetermined period of time from the time when the replaceable unit has been replaced. That is, when a replaceable unit, which has been replaced, is genuine and an operation mode is switched to other operation mode, the control unit controls the image forming apparatus to operate in the second mode for a predetermined period of time from the time when the replaceable unit has been replaced. Therefore, it is possible to reduce bad effects caused by a state before a replaceable unit is replaced.

According to a third aspect of the invention, there is provided an image forming apparatus comprising: an image forming apparatus main body; at least one toner cartridge unit replaceably mounted in the image forming apparatus main body; a developer container connected to the toner cartridge; a detecting unit that detects whether or not the toner cartridge has been replaced; an input unit for selecting a first operation mode corresponding to the toner cartridge which is genuine or a second operation mode other than the first operation mode, and a control unit that performs control in an operation mode selected by the input unit, wherein, when the detecting unit detects that the toner cartridge has been replaced, the control unit controls the image forming apparatus to operate in an operation mode before the replacement of the toner cartridge unit, for a predetermined period of time from the time when the toner cartridge has been replaced. That is, when a toner cartridge has been replaced with a genuine article or any one other than a genuine article, even if a toner before replacement of the toner cartridge remains in a connecting unit or the like, the control unit controls the image forming apparatus to operate in an operation mode before other operation mode is selected, for a predetermined period of time from the time when the toner cartridge has been replaced. Therefore, it is possible to reduce bad effect caused by a toner remaining in a connecting unit or the like.

According to a fourth aspect of the invention, there is provided an image forming apparatus including an image forming apparatus main body; at least one replaceable unit replaceably mounted in the image forming apparatus main body, a storage unit provided in the replaceable unit for storing information on a consumption of the replaceable unit, a discriminating unit that discriminates whether or not the replaceable unit is genuine on the basis of the information on a consumption read from the storage unit, a message output unit that outputs a message according to a discrimination result by the discriminating unit, an input unit for selecting any one of a first operation mode corresponding to the replaceable unit which is genuine and other operation modes than the first operation mode, and a control unit that performs control in an operation mode selected by the input unit, wherein the discriminating unit determines a cumulative consumption of the replaceable unit on the basis of the information on the consumption read from the storage unit, and if the determined cumulative consumption is between a first reference value that needs replacing the replaceable unit which is genuine, and a second reference value which is greater than that the first reference value, the discriminating unit discriminates that the replaceable unit is genuine.

Preferably, the storage unit stores the information on the consumption of the replaceable unit, and information indicating a destination of the replaceable unit; and the discriminating unit discriminates whether or not the replaceable unit is genuine, on the basis of the information on the consumption and the information indicating a destination, which are read from the storage unit.

Preferably, the second reference value is a cumulative consumption that cannot be used by the replaceable unit which is genuine, and the discriminating unit determines the cumulative consumption of the replaceable unit on the basis of the read information on the consumption, and if the determined cumulative consumption exceeds the second reference value, the discriminating unit discriminates that the replaceable unit is not genuine.

Preferably, the discriminating unit determines the cumulative consumption of the replaceable unit on the basis of the read information on the consumption, and if the determined cumulative consumption is smaller than the first reference value, the discriminating unit discriminates that the replaceable unit is genuine.

Preferably, if the cumulative consumption determined on the basis of the information on the consumption read from the storage unit is between a first limit and a second limit, the message output unit outputs a message that urges a user to input whether or not the replaceable unit is genuine, and the control unit switches a current operation mode to another operation mode according to a response to the message.

Preferably, the discriminating unit determines the cumulative consumption of the replaceable unit, on the basis of the information on the consumption of the replaceable unit read from the storage unit and a consumption of the replaceable unit to be used during an image forming process.

According to a fifth aspect of the invention, there is provided an image forming apparatus including an image forming apparatus main body; at least one replaceable unit replaceably mounted in the image forming apparatus main body; a storage unit provided in the replaceable unit for storing information on a consumption of the replaceable unit; a discriminating unit that discriminates whether or not the replaceable unit is genuine on the basis of information on the consumption read from the storage unit, a first reference value that needs replacing the replaceable unit, and a second reference value which is greater than the first reference value, and a control unit that performs control in a first operation mode corresponding to the replaceable unit which is genuine or in other operation mode than the first operation mode on the discrimination result by the discriminating unit, wherein, if the other operation mode is set, and a cumulative consumption of the replaceable unit determined on the basis of the information on the consumption is between the first reference value and the second reference value, the control unit switches the other operation mode to the first operation mode.

According to a sixth aspect of the invention, there is provided a method of controlling an image forming apparatus in which at least one replaceable unit is replaceably mounted in an image forming apparatus main body, the method including the steps of: reading information on a consumption of the replaceable unit from a memory provided in the replaceable unit; determining a cumulative consumption of the replaceable unit on the basis of the read information on the consumption; and, if the determined cumulative consumption is between a first reference value that needs replacing the replaceable unit and a second reference value which is greater than the first reference value, and an operation mode corresponding to the replaceable unit which is not genuine is set, switching the set operation mode to an operation mode corresponding to the replaceable unit which is genuine.

According to a seventh aspect of the invention, there is provided a method of controlling an image forming apparatus in which at least one replaceable unit is replaceably mounted in an image forming apparatus main body, the method including the steps of: reading information on a consumption of the replaceable unit from a memory provided in the replaceable unit; determining a cumulative consumption of the replaceable unit on the basis of the read information on the consumption; and, if the determined cumulative consumption is between a first reference value that needs replacing the replaceable unit and a second reference value which is greater than the first reference value, and an operation mode corresponding to the replaceable unit which is not genuine is set, outputting a message notifying a user of what an operation mode corresponding to the replaceable unit which is genuine can be applied, or a message notifying the user of what the mounted replaceable unit is genuine.

Meanwhile, the operation mode mentioned herein means aspects of control of an image forming apparatus, and includes not only programs and control parameters for forming an image, but also input and output conditions, and further includes aspects of display onto a display device, which are not directly related to the image formation.

According to the present invention, a user can use a replaceable unit other than a genuine article, by the user's intention, even when the replaceable unit other than a genuine article is mounted. Further, according to the present invention, when a replaceable unit has been replaced, it is possible to reduce bad effects caused by a state before the replaceable unit has been replaced.

Further, according to the present invention, a user can use a replaceable unit other than a genuine article, by the user's intention, even when the replaceable unit other than a genuine article is mounted. Further, according to the present invention, it is discriminated whether or not a replaceable unit is genuine or not, thereby helping a user to select an operation mode suitable for the replaceable unit.

BRIEF DESCRIPTION OF THE DRAWINGS

These and other objects and advantages of this invention will become more fully apparent from the following detailed description taken with the accompanying drawings in which:

FIGS. 16A and 16B are graphs showing results corrected by the setting shown in FIG. 15, in which FIG. 16A shows a corrected toner density, and FIG. 16B shows a corrected image density;

FIGS. 21A and 21B illustrate screens displayed on the UI device, in which FIG. 21A is a screen for input when a user selects an operation mode corresponding to a genuine article, FIG. 21B is a screen for input when a user selects an operation mode corresponding to any one other than a genuine article;

FIG. 31A illustrate screens displayed on a UI device in which FIG. 31A is an operation mode selecting screen 299*a* when a genuine toner cartridge is mounted.

DETAILED DESCRIPTION OF THE PREFERRED EMBODIMENTS

First Embodiment

Hereinafter, embodiments of the present invention will be described with reference to the accompanying drawings.

Figure 1:
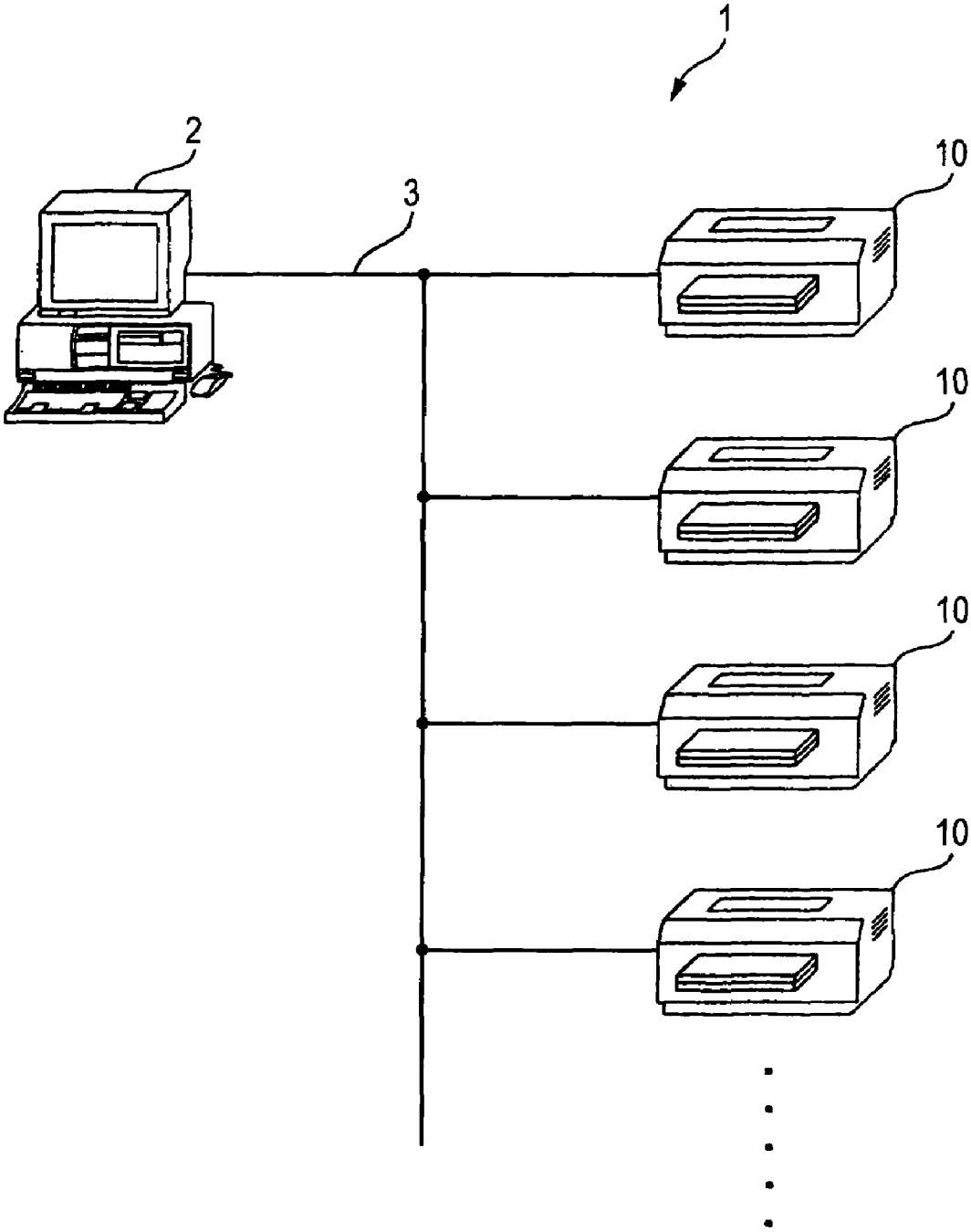
FIG. 1 is a schematic diagram of an image forming system according to an embodiment of the present invention.

FIG. 1 illustrates an image forming system 1 according to an embodiment of the present invention. The image forming system 1 is constructed by connecting a host apparatus 2, such as a personal computer (PC) to, for example, a plurality of image forming apparatuses 10 via a network 3. The host apparatus 2 may be a terminal having a control device, such as a micro controller unit (MCU), an input-output device, such as a touch panel, and a communication device for transmitting or receiving signals via the network 3, except the PC. The network 3 may be constructed by wire or wireless. Further, a plurality of the host apparatuses 2 may be connected to the network 3.

As such, the image forming system 1 is constructed such that the host apparatus 2 can control the image forming apparatuses 10 via the network 3.

Figure 2:
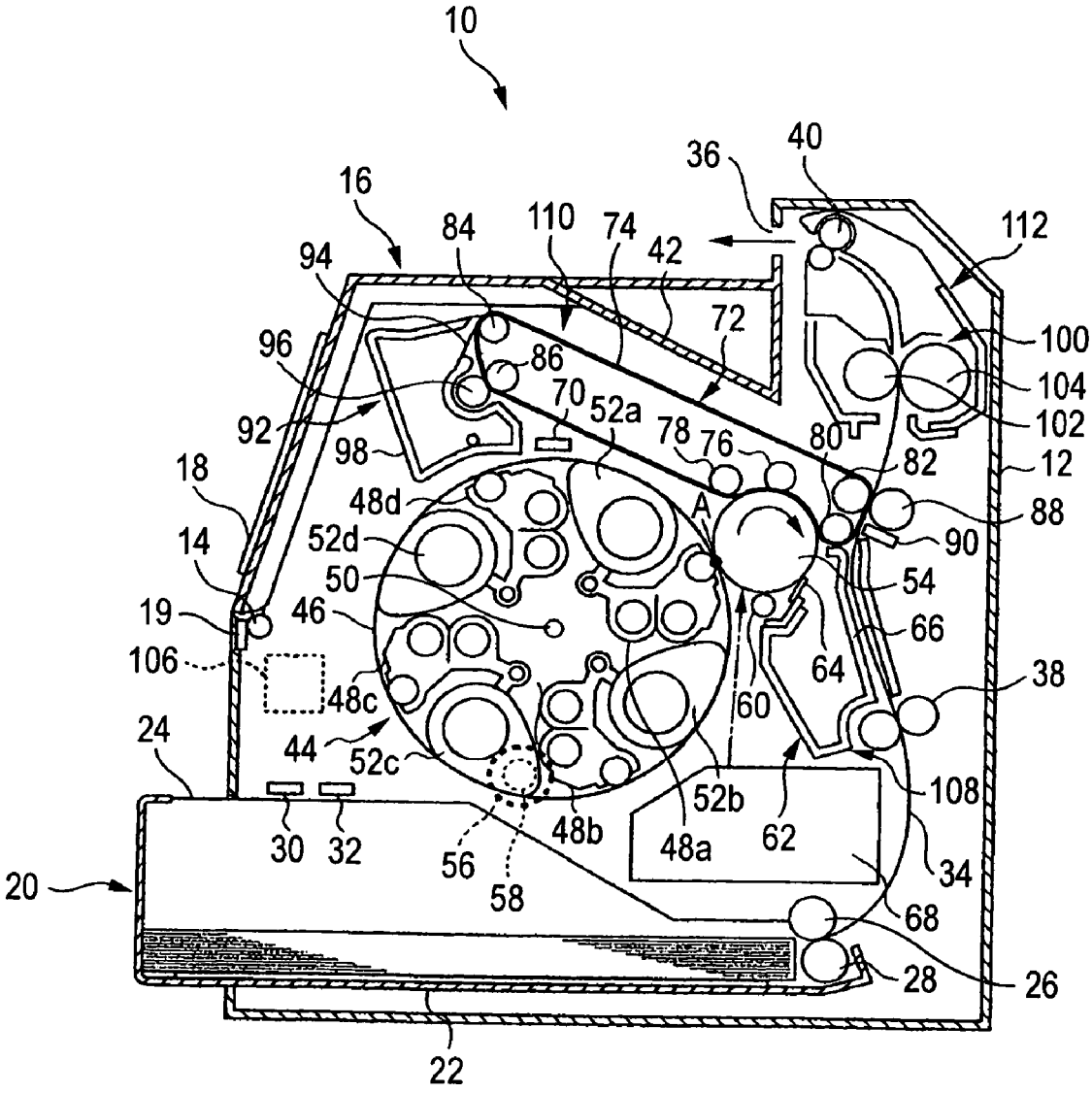
FIG. 2 is a side view schematically illustrating an image forming apparatus according to the embodiment of the present invention.

FIG. 2 schematically illustrates an image forming apparatus 10. The image forming apparatus 10 has an image forming apparatus main body 12, and an opening and closing cover 16 is provided at an upper portion of the image forming apparatus main body 12 to rotate about a fulcrum 14. A user interface device (UI device) 18, such as a touch panel, is provided on the front side (the left side in FIG. 2) of the opening and closing cover 16. The UI device 18 displays control information or instruction information of the image forming apparatus 10, and the instruction information from a user is input to the UI device 18. That is, a user can operate the image forming apparatus 10 via the UI device 18. Meanwhile, the UI device 18 may be a device for performing only the input of signals, such as a switch, or may be a device for receiving only the output of signals, such as display. Otherwise, the UI device 18 may be a combined device for performing both the input and output of signals.

Further, an opening and closing detecting sensor 19 is provided in the vicinity of the fulcrum 14 to detect the opening or closing of the opening and closing cover 16 by contact or separation according to opening or closing of the opening and closing cover 16.

For example, one-stage sheet feeding unit 20 is provided at a lower portion of the image forming apparatus main body 12. The sheet feeding unit 20 has a sheet feeding unit main body 22 and a sheet feeding cassette 24 for receiving sheets. A feeding roller 26 for feeding sheets from the sheet feeding cassette 24 and a retard roller 28 for separating the fed sheets one by one are arranged at the upper portion of the vicinity of a rear end of the sheet feeding cassette 24. Further, a temperature sensor 30 for detecting the temperature in the image forming apparatus main body 12 and a humidity sensor 32 for detecting the humidity in the image forming apparatus main body 12 are provided above the sheet feeding cassette 24.

A conveying path 34 is a sheet conveying path from the feeding roller 26 to a discharge port 36, and the conveying path 34 is formed substantially vertically from the sheet feeding unit 20 to a fixing device 100, which will be described later, in the vicinity of the rear side (the right side in FIG. 2) of the image forming apparatus main body 12. A secondary transfer roller 88 and a secondary transfer backup roller 82, which will be described later, are arranged upstream of the fixing device 100 in the conveying path 34, and a resist roller 38 is arranged downstream of the secondary transfer roller 88 and the secondary transfer backup roller 82. Further, a discharge roller 40 is arranged in the vicinity of the discharge port 36 in the conveying path 34.

Accordingly, the sheets fed by the feeding roller 26 from the sheet feeding cassette 24 of the sheet feeding unit 20 are separated by the retard roller 28, and only the topmost sheet is guided to the conveying path 34. Then, the conveyance of the guided sheet is temporally stopped by the resist roller 38, and the sheet passes between the secondary transfer roller 88 and the secondary transfer backup roller 82, which will be described later, at a predetermined timing, so that a toner image is transferred onto the sheet. Subsequently, the transferred toner image is fixed by the fixing device 100, and the sheet is then discharged by the discharge roller 40 from the discharge port 36 to a discharge section 42 provided on the upper side of the opening and closing cover 16. The discharge section 42 slopes gradually downward from the front side (the left side in FIG. 2) thereof toward the discharge port.

A developer container unit 44, such as a rotary developing device, is arranged, for example, substantially at the center of the image forming apparatus main body 12. The developer container unit 44 has a developer container unit main body 46, and the developer container unit main body 46 is mounted with four developer containers 48*a* to 48*d* for forming a toner image. These developer containers 48*a* to 48*d* rotate left (in the counterclockwise direction in FIG. 2) about a rotating shaft 50 with the developer container unit main body 46. The developer containers 48*a* to 48*d* are mounted with tubular toner cartridges 52*a* to 52*d* for containing toners of yellow (Y), magenta (M), cyan (C), and black (K), respectively. When the toner cartridges 52*a* to 52*d* are mounted in the developer container unit main body 46 through the developer containers 48*a* to 48*d*, the toner cartridges 52*a* to 52*d* are mounted such that their outer surfaces almost coincide with the outer circumference of the developer container unit main body 46.

An image carrier 54 made of, for example, a photoreceptor is arranged so as to abut on the developer container unit 44 from the rear side (the right side in FIG. 2) of the image forming apparatus 10. Specifically, four colors of Y, M, C, and K are prepared in the developer container unit 44 to perform full color development, and the developer containers 48*a* to 48*d* are rotated and positioned at positions to face the image carrier 54 and then develop a latent image on the image carrier 54, using the toners of respective colors of yellow (Y), magenta (M), cyan (C) and black (B), sequentially.

Further, a wireless communication unit 56 is arranged in the vicinity of a position substantially opposite to the image carrier 54 with respect to the rotating shaft 50 of the developer container unit 44. The wireless communication unit 56 has an antenna 58 and communicates with memory chips 170, which will be described later, by wireless.

Further, an electrifying device 60 including, for example, an electrifying roller, is provided below the image carrier 54 for uniformly electrifying the image carrier 54. Further, an image carrier cleaner 62 abuts on the image carrier 54 upstream of the electrifying device 60 in the rotating direction of the image carrier 54. The image carrier cleaner 62 includes a cleaning blade 64 for scraping off a toner remaining on the image carrier 54 after a primary transfer and a waste toner collecting bottle 66 for collecting the toner scraped off by the cleaning blade 64.

Meanwhile, for example, ribs are formed on the rear side (the right side in FIG. 2) of the waste toner collecting bottle 66, and the rear surface of the waste toner collecting bottle 66 is formed into a curved surface such that sheets can be smoothly conveyed. Further, the rear surface of the waste toner collecting bottle 66 constitutes a portion of the conveying path 34.

Further, an exposure device 68 for writing a latent image on the image carrier 54 electrified by the electrifying device 60, using light rays, such as laser beam, is provided below the rear side of the developer container unit 44. Further, an unused state detecting sensor 70, such as a reflective photosensor, for detecting whether the toner cartridges 52*a* to 52*d* mounted in the developer container unit 44 are unused, is provided above the developer container unit 44. An intermediate transfer device 72 is provided above the developer container unit 44 and the unused state detecting sensor 70. The intermediate transfer device 72 primarily transfers the toner image visualized by the developer container unit 44 for each color at a primary transfer position whenever an intermediate transfer body 74 makes one rotation such that the toner image having four colors are superposed on the intermediate transfer body 74, and then collectively transfers the toner image on a sheet at a secondary transfer position which will be described later.

The intermediate transfer device 72 includes an intermediate transfer body 74, such as an intermediate transfer belt, a primary transfer roller 76, a lap-in roller 78, a lap-out roller 80, a secondary backup roller 82, a scraper backup roller 84, and a brush backup roller 86. The intermediate transfer body 74 has, for example, elasticity, and is substantially flatly stretched such that it has long sides and short sides above the developer container unit 44. The upper long side of the intermediate transfer body 74 is stretched such that it is substantially parallel to the discharge section 42 provided on the upper side of the image forming apparatus main body 12. Further, the intermediate transfer body 74 has a primary transfer section (an image carrier lap region) to abut on the image carrier 54 in the shape of a lap between the lap-in roller 78 arranged upstream of the primary transfer roller 76 at the lower long side thereof, and the lap-out roller 80 arranged downstream of the primary transfer roller 76. Also, the intermediate transfer body 74 is wound around the image carrier 54 by a predetermined range to follow the rotation of the imager carrier 54.

Moreover, a planar surface (a short side) is formed at the rear side (the right side in FIG. 2) of the intermediate transfer body 74 by the lap-out roller 80 and the secondary transfer backup roller 82. The planar surface forms a secondary transfer section so as to face the conveying path 34.

As such, a toner image on the image carrier 54 is repeatedly and primarily transferred onto the intermediate transfer body 74 in order of, for example, yellow, magenta, cyan and black by the primary transfer roller 76, and the primarily transferred toner image is then carried toward the secondary transfer section.

The scraper backup roller 84 assists a scraper 94, which will be described later, in scraping off a toner remaining on the intermediate transfer body 74 after the secondary transfer, and the brush backup roller 86 assists a brush roller 96, which will be described later, in scraping off a toner remaining on the intermediate transfer body 74 after the secondary transfer.

The secondary transfer roller 88 and the secondary transfer backup roller 82 of the intermediate transfer device 72 face each other with the conveying path 34 interposed therebetween. Specifically, a position between the secondary transfer roller 88 and the secondary transfer backup roller 82 becomes a secondary transfer position in the secondary transfer section, and the secondary transfer roller 88 secondarily transfers the toner image primarily transferred onto the intermediate transfer body 74 onto a sheet at the secondary transfer position by the assistance of the secondary transfer backup roller 82. Here, the secondary transfer roller 88 is separated from the intermediate transfer body 74 while the intermediate transfer body 74 rotates three times, i.e., while toner images having three colors of yellow, magenta and cyan, respectively, are carried, whereas the secondary transfer roller 88 abuts on the intermediate transfer body 74 when the black toner image has been transferred. Meanwhile, there is a predetermined potential difference between the secondary transfer roller 88 and the secondary transfer backup roller 82. For example, when the secondary transfer roller 88 has a high voltage, the secondary transfer backup roller 82 is connected to a ground (GND) or the like.

Upstream of the secondary transfer position, an image density sensor 90, such as a reflective photosensor, is arranged opposite to the intermediate transfer body 74 with the conveying path 34 interposed therebetween. The image density sensor 90 reads out a patch of a toner formed on the intermediate transfer body 74, and detects the density of the image formed on the intermediate transfer body 74.

A cleaner 92 for an intermediate transfer body is provided to abut on an end of the intermediate transfer body 74 opposite to the image carrier. The cleaner 92 for an intermediate transfer body includes, for example, a scraper 94 which scrapes and cleans a toner remaining on the intermediate transfer body 74 after the secondary transfer, a brush roller 96 which further scrapes a toner remaining after the cleaning by the scraper 94, and a waste toner collecting bottle 98 which collects the toner scraped by the scraper 94 and the brush roller 96. The scraper 94 is made of, for example, a stainless thin plate. A voltage having polarity reverse to that of the toner is applied to the scraper 94. The brush roller 96 has, for example, a brush such as acryl subjected to conductive treatment. Further, while the intermediate transfer body 74 carries a toner image, the scraper 94 and the brush roller 96 are separated from the intermediate transfer body 74, whereas they are integrated with each other at a predetermined timing so as to abut on the intermediate transfer body 74.

A fixing device 100 is arranged above the secondary transfer position. The fixing device 100 has a heating roller 102 and a pressing roller 104, fixes a toner image secondarily transferred onto a sheet by the secondary transfer roller 88 and the secondary transfer backup roller 82 on the sheet, and conveys the sheet toward the discharge roller 40.

Further, a control unit 106 is arranged in the image forming apparatus main body 12 for controlling respective parts that constitute the image forming apparatus 10.

An image carrier unit 108 is constructed by integrating the image carrier 54, the electrifying device 60, and the image carrier cleaner 62 with each other. Further, an image forming unit 110 is constructed by integrating the image carrier unit 108, the intermediate transfer device 72 and the cleaner 92 for an intermediate transfer body with each other. Moreover, a fixing unit 112 is constructed by integrating the fixing device 100 and the discharge roller 40 with each other.

Figure 3:
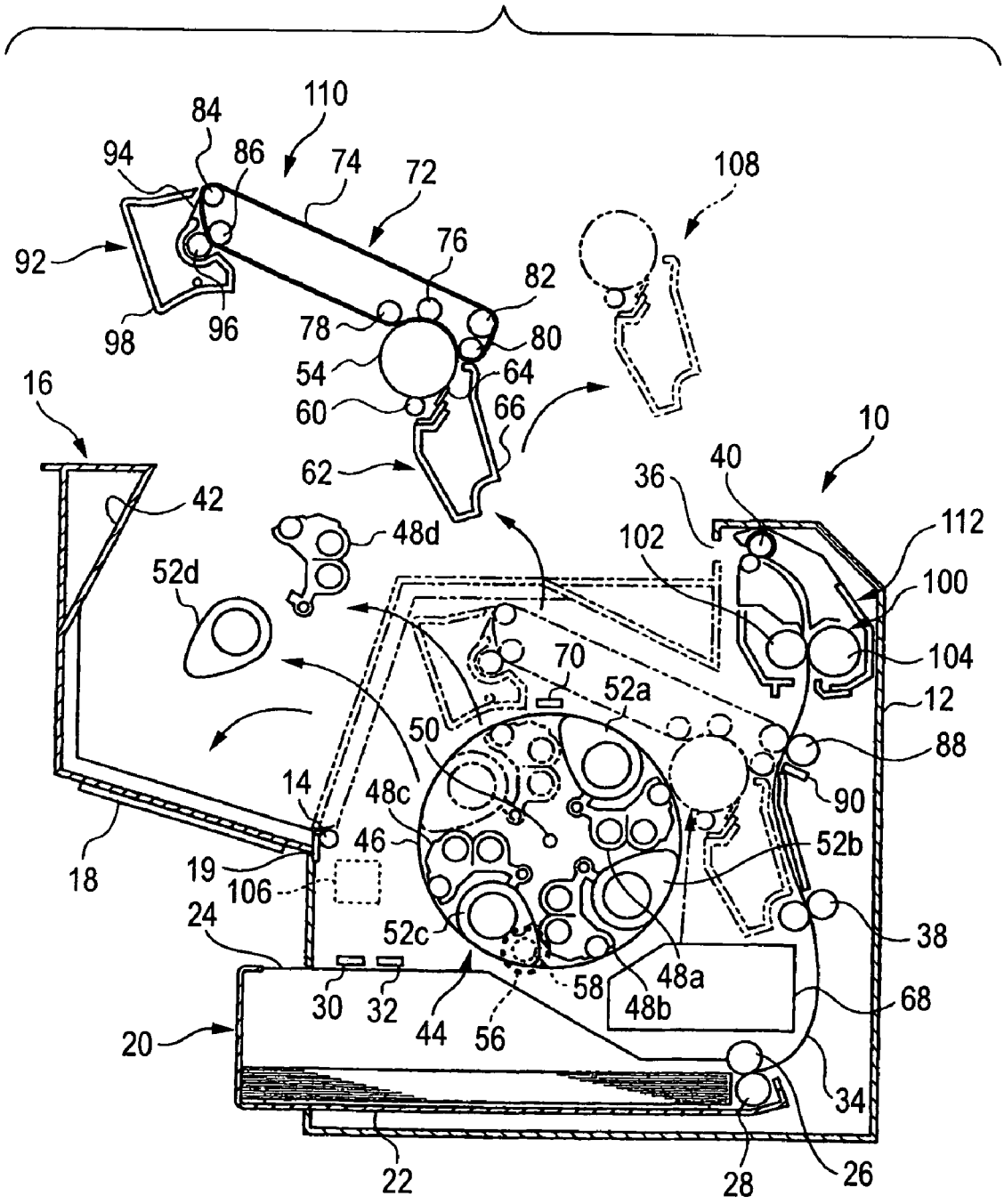
FIG. 3 is a side view illustrating a state in which replaceable units of the image forming apparatus according to the embodiment of the present invention are detached from an image forming apparatus main body.

As also illustrated in FIG. 3, the image forming unit 110 is adapted to be attachable to or detachable from the image forming apparatus main body 12, and is attached to or detached from the image forming apparatus main body by opening the opening and closing cover 16. Further, the image carrier unit 108 is adapted to be attachable to or detachable from the image forming unit 110.

When the opening and closing cover 16 is opened and the toner cartridges 52*a* to 52*d* are positioned on the front side (on the side of the opening and closing cover 16), the toner cartridges 52*a* to 52*d* are adapted to be attachable to or detachable from the developer containers 48*a* to 48*d* mounted in the developer container unit main body 46. When the opening and closing cover 16 is opened and the developer containers 48*a* to 48*d* are located on the front side (on the side of the opening and closing cover 16), the developer containers 48*a* to 48*d* are adapted to be attachable to or detachable from the developer container unit main body 46.

The fixing unit 112 is adapted to be attachable to or detachable from the image forming apparatus main body 12 by detaching a top cover (not shown). Further, other units, such as the developer container unit 44 and the sheet feeding unit 20, are adapted to be attachable to or detachable from the image forming apparatus main body 12.

As such, the respective units can be replaced by a user. On the other hand, in case a user mounts a replaceable unit in the image forming apparatus 10, if the replaceable unit is any one other than a genuine article for the image forming apparatus 10, a problem occurs in that good image quality cannot be maintained and the operation cannot be guaranteed. This is because the image forming apparatus 10 is controlled in accordance with the characteristics of members used for the image forming apparatus 10. Thus, units replaceable by a user are provided with sensors that detect predetermined conditions.

Hereinafter, if any one of a plurality of components, such as the developer containers 48*a* to 48*d*, is not specified, the developer containers are abbreviated as, simply, a "developer container 48".

Next, examples of replaceable units having sensors for detecting predetermined conditions will now be described.

Figure 4:
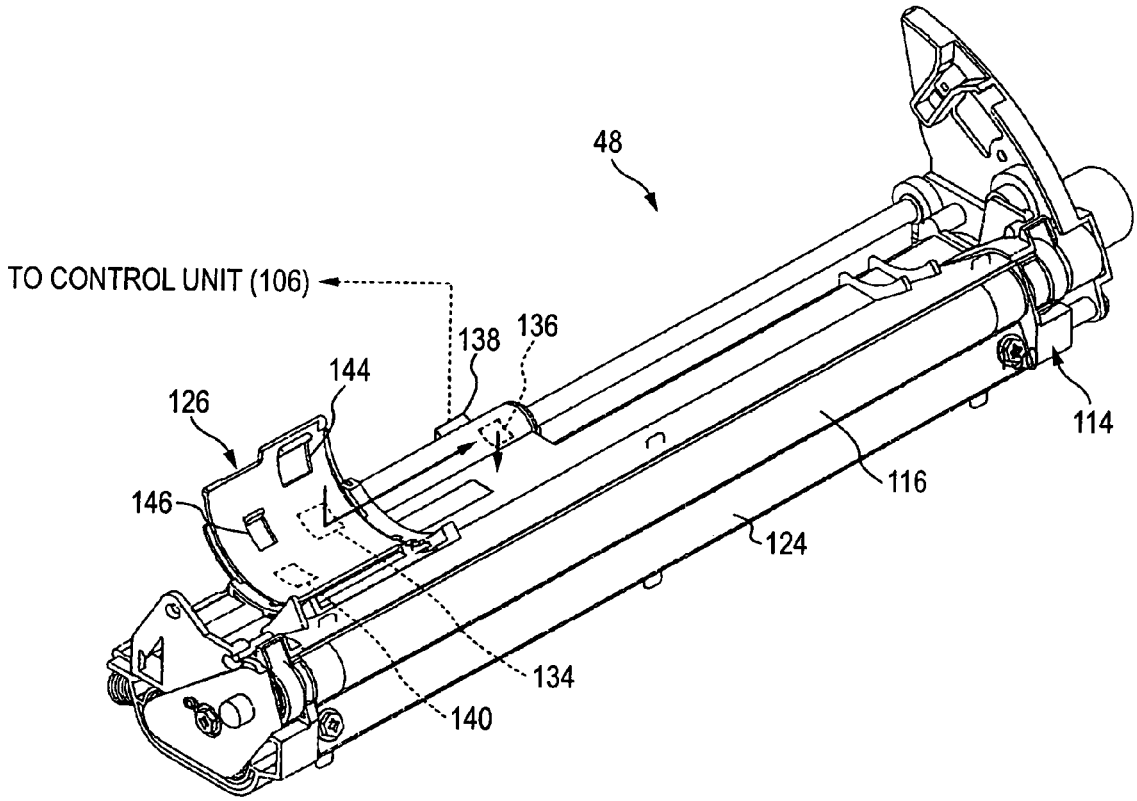
FIG. 4 is a perspective view illustrating a developer container of the image forming apparatus according to the embodiment of the present invention.
Figure 5:
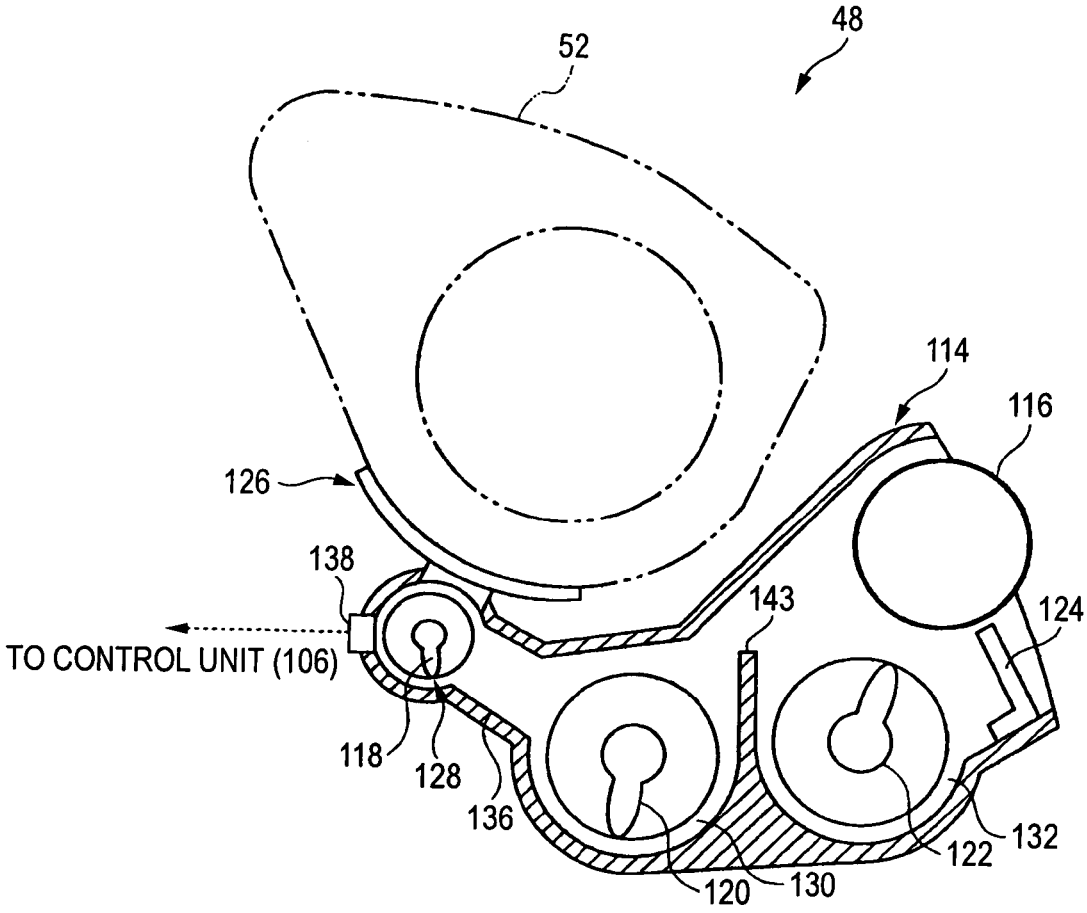
FIG. 5 is a schematic view illustrating a cross-section of the developer container of the image forming apparatus according to the embodiment of the present invention.

FIGS. 4 and 5 illustrate a construction of a developer container 48 that is a replaceable unit.

The developer container 48 has a developing roller 116 serving as a developer carrier arranged on the image carrier 54 side of a developer container housing (a developer container main body) 114, a first auger 118, a second auger 120, a third auger 122, and a layer thickness regulating member 124. The developer container 48 also contains, for example, a two-component developer consisting of a non-magnetic toner and a magnetic carrier.

The developer container housing 114 has a shutter 126 for opening or closing a toner receiving port 134 and a developer discharge port 140, which will be described later, a tubular take-in conveying path 128 for conveying a toner taken in from the toner cartridge 52, and tubular developer conveying paths 130 and 132 for agitating and conveying a toner and a carrier.

The take-in conveying path 128 has a toner receiving port 134 for receiving a toner from the toner cartridge 52, and a toner feeding port 136 for feeding a toner to the developer conveying path 130. The first auger 118 is arranged in the take-in conveying path 128. The first auger 118 conveys a toner received from the toner cartridge 52 by the take-in conveying path 128, to the developer conveying path 130. Further, the rotation of the first auger 118 is regulated so that the amount of a toner supplied to the developer container 48 from the toner cartridge 52 can be regulated. Thus, a CPU 202 may cumulate the driving time and revolution number of the first auger 118 such that the consumption of a toner (the consumption of the toner cartridge 52) can be calculated. Further, the consumption of a toner may be calculated by storing, as electric charges, currents flowing through the image carrier 54 to a carrier and the like when the exposure device 68 writes an electrostatic latent image in the image carrier 54, and then by allowing the CPU 202 to count the number of times by which the stored electric charges reaches a predetermined amount.

A toner presence/absence detecting sensor 138 is provided in the take-in conveying path 128 between the toner receiving port 134 and the toner feeding port 136. The toner presence/absence detecting sensor 138 detects the presence or absence of a toner in the take-in conveying path 128, for example, by detecting a change in a resistance value depending on the presence or absence of a toner between two points in the take-in conveying path 128. Further, the toner presence/absence detecting sensor 138 may be a piezoelectric element.

The developer conveying path 130 has a developer discharge port 140 for discharging a surplus developer to the toner cartridge 52, and the second auger 120 is arranged in the developer conveying path 130. The second auger 120 agitates a toner conveyed through the take-in conveying path 128, and a carrier, and conveys the resulting mixture to the developer conveying path 132.

The third auger 122 is arranged in the developer conveying path 132. The third auger 122 agitates and conveys a developer through the developer conveying path 130, and supplies the resultant to the developing roller 116.

Meanwhile, a partition plate 143 is provided between the developer conveying path 130 and the developer conveying path 132. Passageways (not shown) are provided at both ends of the partition plate 143 for connecting the developer conveying path 130 and the developer conveying path 132. Thus, the second auger 120 and the third auger 122 convey a developer in directions different from each other so that a toner can be frictionally electrified so as to have predetermined polarity and electric charge quantity by the carrier and can be circulated in the developer container housing 114. Further, a deteriorated developer is discharged to the toner cartridge 52 from the developer discharge port 140 at a predetermined timing so that the total lifetime of the developer can be prolonged (a trickle development method).

The shutter 126 has openings 144 and 146. The opening 144 is overlapped with the toner receiving port 134 to form a passageway for a toner from the toner cartridge 52 to the developer container 48, and the opening 146 is overlapped with the developer discharge port 140 to form a passageway for a surplus developer from the developing container 48 to the toner cartridge 52.

The developing roller 116 abuts on the image carrier 54 while carrying a toner, thereby developing an electrostatic latent image carried by the image carrier 54 with the toner. The layer thickness regulating member 124 regulates the layer thickness of a toner carried by the developing roller 116.

Figure 6:
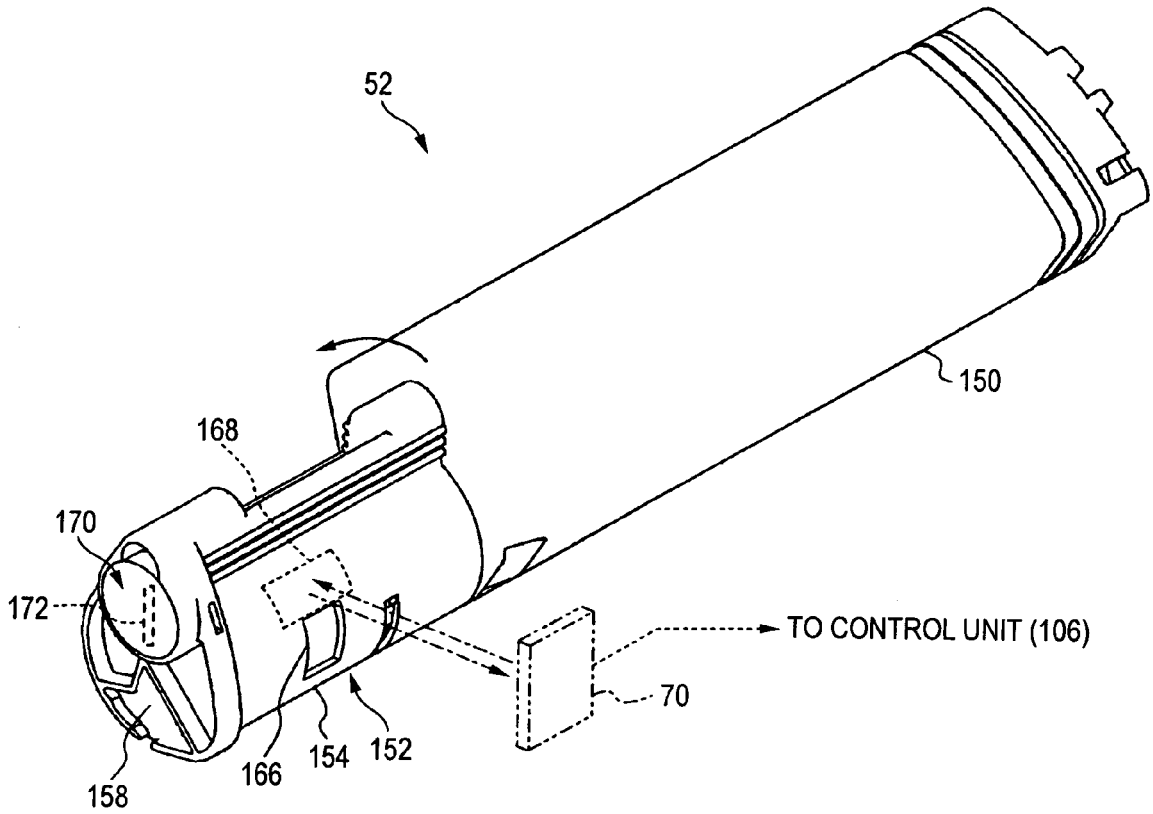
FIG. 6 is a perspective view illustrating a toner cartridge of the image forming apparatus according to the embodiment of the present invention.
Figure 7:
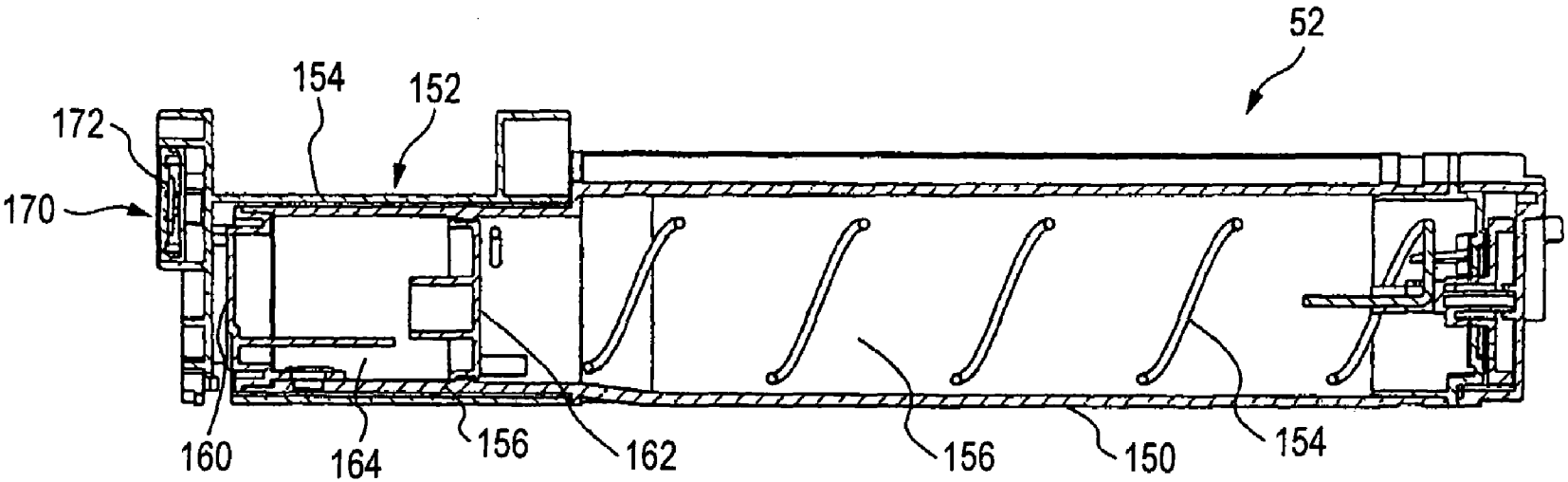
FIG. 7 is a sectional view illustrating the toner cartridge of the image forming apparatus according to the embodiment of the present invention.

FIGS. 6 and 7 illustrate a construction of the toner cartridge 52 that is a replaceable unit.

The toner cartridge 52 has a toner cartridge main body 150, and a rotating member 152 provided at a longitudinal end of the toner cartridge main body 150.

The toner cartridge main body 150 is formed in a tubular shape, and is formed such that a substantially cylindrical portion having an agitating and conveying member 154 arranged therein and a portion extending from the substantially tubular portion in a direction substantially perpendicular to its longitudinal direction so as to be gradually narrowed are integrated with each other. Further, when the toner cartridge 52 is mounted in the developer container unit main body 46 via the developer container 48, the toner cartridge main body 150 is configured such that its outer surface substantially coincides with the outer circumference of the developer container main body 46.

A toner accommodating space 156 is formed in the toner cartridge main body 150 for accommodating a toner to be supplied to the developer container 48. The above-mentioned agitating and conveying member 154 is provided in the toner accommodating space 156. The agitating and conveying member 154 is wound in, for example, a spiral shape, and agitates a toner in the toner accommodating space 156 and conveys the agitated toner toward the toner receiving port 134 of the developer container 48.

The rotating member 152 has a rotating member main body 154, and a cylindrical tubular part 156 provided in the rotating member main body 154 and integrally formed with the toner cartridge main body 150. The tubular part 156 is sealed up at a lateral face 158 of the rotating member main body 154 by a tubular part sidewall 160, and has an isolating wall 162 provided therein. A developer collecting space 164 for collecting a surplus developer from the developer container 48 is formed at the side of the isolating wall 162 facing the tubular part sidewall 160, and the above-mentioned toner accommodating space 156 is formed to extend at the side of the isolating wall 162 opposite to the tubular part sidewall 160.

The rotating member main body 154 has a window 166 covered with a transparent member, and has the inner surface thereof formed in a cylindrical shape to rotate along the outer surface of the cylindrical portion of a tubular part 156. Further, a reflecting member 168, such as a white tape, is attached to the outer surface of the cylindrical portion of the tubular part 156. When the toner cartridge 52 is mounted in the developer container 48 and the rotating member main body 154 rotates, the reflecting member 168 is exposed through the window 166. Further, when the developer container unit 44 having the toner cartridge 52 mounted therein rotates in the image forming apparatus main body 12, the exposed reflecting member 168 passes through a position which faces the unused state detecting sensor 70 fixed to the image forming apparatus main body 12. As described above, the unused state detecting sensor 70 is, for example, a reflective photosensor. When the reflecting member 168 of the toner cartridge 52 mounted in the developer container unit 44 passes through a position which faces the unused state detecting sensor 70, the unused state detecting sensor 70 detects the quantity of reflection of the reflecting member 168 which varies depending on dirt by a toner, thereby detecting whether or not the toner cartridge 52 is unused.

A memory chip 170 is attached to the lateral face 158 of the rotating member main body 154. The memory chip 170 has an antenna 172, and performs wireless communication with the wireless communication unit 56 provided on the image forming apparatus main body 12.

Next, regarding the wireless communication unit 56 and the memory chip 170, a circuit configuration of each thereof and communication performed therebetween will now be described.

Figure 8:
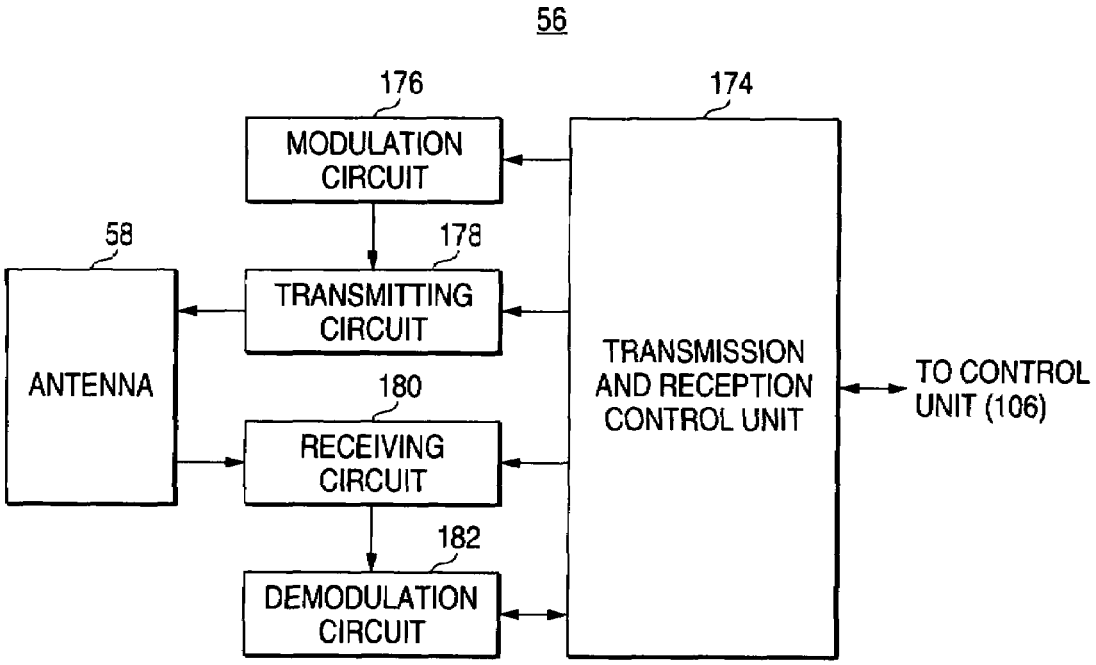
FIG. 8 is a block diagram showing a circuit configuration of a wireless communication unit of the image forming apparatus according to the embodiment of the present invention.
Figure 9:
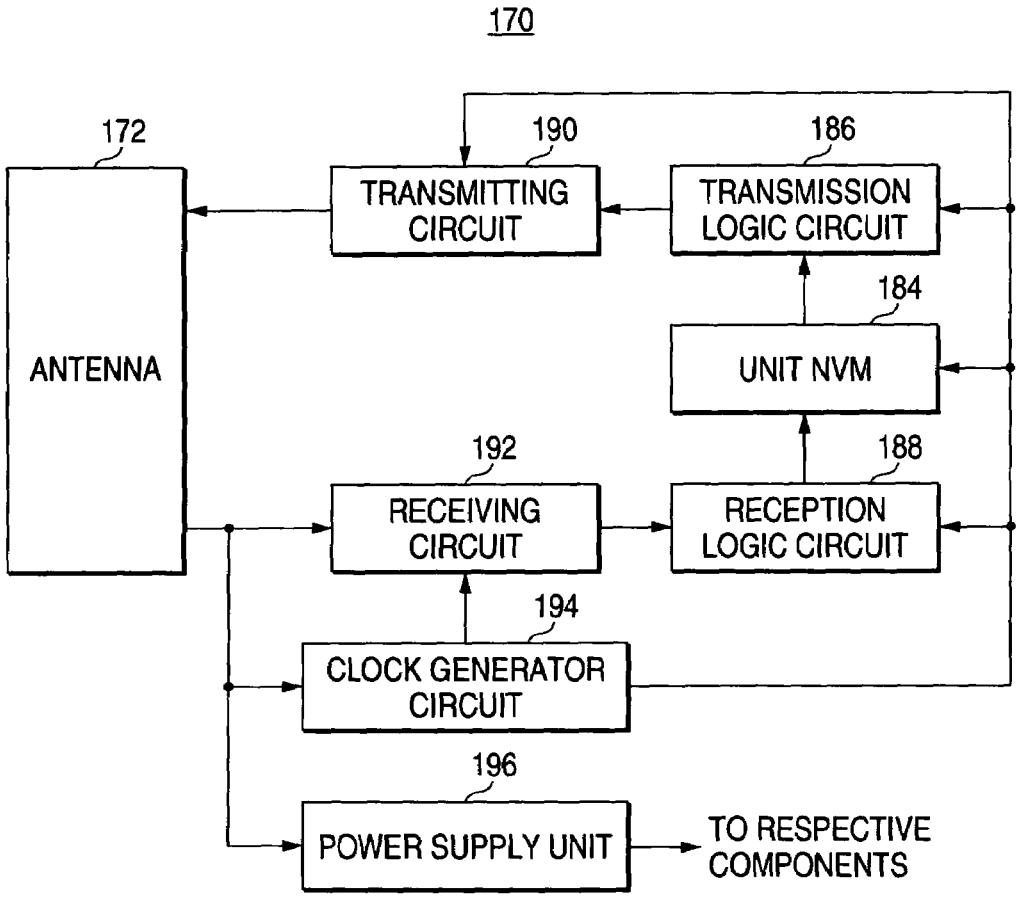
FIG. 9 is a block diagram showing a circuit configuration of a memory chip of a toner cartridge used for the image forming apparatus according to the embodiment of the present invention.

FIG. 8 is a block diagram showing a circuit configuration of the wireless communication unit 56. FIG. 9 is a block diagram showing a circuit configuration of the memory chip 170.

As illustrated in FIG. 8, a circuit of the wireless communication unit 56 includes a transmission and reception control unit 174, a modulation circuit 176, a transmitting circuit 178, a receiving circuit 180, a demodulation circuit 182, and an antenna 58. In the wireless communication unit 56, the transmission and reception control unit 174 controls the operation of the respective components of the wireless communication unit 56. Also, the transmission and reception control unit 174 outputs data input from the control unit 106 to the demodulation circuit 176. Further, the transmission and reception control unit 174 outputs data received by the receiving circuit 180 and demodulated by the demodulation circuit 182 to the control unit 106. The modulation circuit 176 modulates data input from the transmission and reception control unit 174 and outputs the modulated data to the transmitting circuit 178. The transmitting circuit 178 outputs radio signals, including data and clock signals to be stored in the memory chip 170, to the memory chip 170 via the antenna 58.

The receiving circuit 180 receives signals transmitted from the memory chip 170 via the antenna 58, and outputs the received signals to the demodulation circuit 182. The demodulation circuit 182 demodulates data transmitted by the memory chip 170 depending on a change in the signals input from the receiving circuit 180, and outputs the demodulated data to the transmission and reception control unit 174.

As illustrated in FIG. 9, a circuit of the memory chip 170 includes a unit nonvolatile memory (NVM) 184, a transmission logic circuit 186, a reception logic circuit 188, a transmitting circuit 190, a receiving circuit 192, a clock regenerator circuit 194, a power supply unit 196, and an antenna 172.

When radio signals are transmitted from the wireless communication unit 56 to the memory chip 170, the receiving circuit 192, the clock regenerator circuit 194 and the power supply unit 196 receive the radio signals via the antenna 172. In the memory chip 170, when the radio signals were received, the power supply unit 196 rectifies a current caused by the electromagnetic induction by the radio signals, and supplies electric power required for the operation of the respective components of the memory chip 170 to the components. For example, when a voltage higher than that generated by the power supply unit 196 is required, the memory chip 170 may be configured to receive the power supplied from the main body 40. For example, power may be supplied in a non-contact way from an alternating current supplied to the developer container unit 44 by further providing the memory chip 170 with power supply coils or the like.

When the clock regenerator circuit 194 receives the radio signals, it regenerates clock signals and outputs the regenerated clock signals to the respective circuits which constitute the memory chip 170. When the receiving circuit 192 receives the radio signals, it outputs signals, such as data included in the radio signals, to the reception logic circuit 188 in synchronization with the clock signals input from the clock regenerator circuit 194. The reception logic circuit 188 demodulates signals, such as data input from the receiving circuit 192, in synchronization with the clock signals input from the clock regenerator circuit 194, and outputs the demodulated signals to the unit NVM 184.

The unit NVM 184 is a writable nonvolatile memory. When signals input from the reception logic circuit 188 in synchronization with the clock signals input from the clock regenerator circuit 194, indicate write-in of data, the unit NVM 184 performs write-in (storing) of the data, and when the signals indicate readout of data, the unit NVM 184 outputs the data stored in the unit NVM 184 to the transmission logic circuit 186. A nonvolatile memory included in the unit NVM 184 may be, for example, a flash read-only memory (flash ROM), an electrically erasable programmable read-only memory (EEPROM), or a ferroelectric random access memory (FeRAM).

The transmission logic circuit 186 modulates data input from the unit NVM 184 in synchronization with the clock signals input from the clock regenerator circuit 194, and outputs the modulated data to the transmitting circuit 190. The transmitting circuit 190 transmits the signals input from the transmission logic circuit 186 to the wireless communication unit 56 via the antenna 172 as radio signals, in synchronization with the clock signals input from the clock regenerator circuit 194.

Meanwhile, signals transmitted or received as the radio signals may be converted into radio signals after their encryption, and may then be transmitted or received. Further, for example, authorized users may rewrite the contents in the unit NVM 184 through any device other than the control unit 106, using encrypted radio signals.

Figure 10:
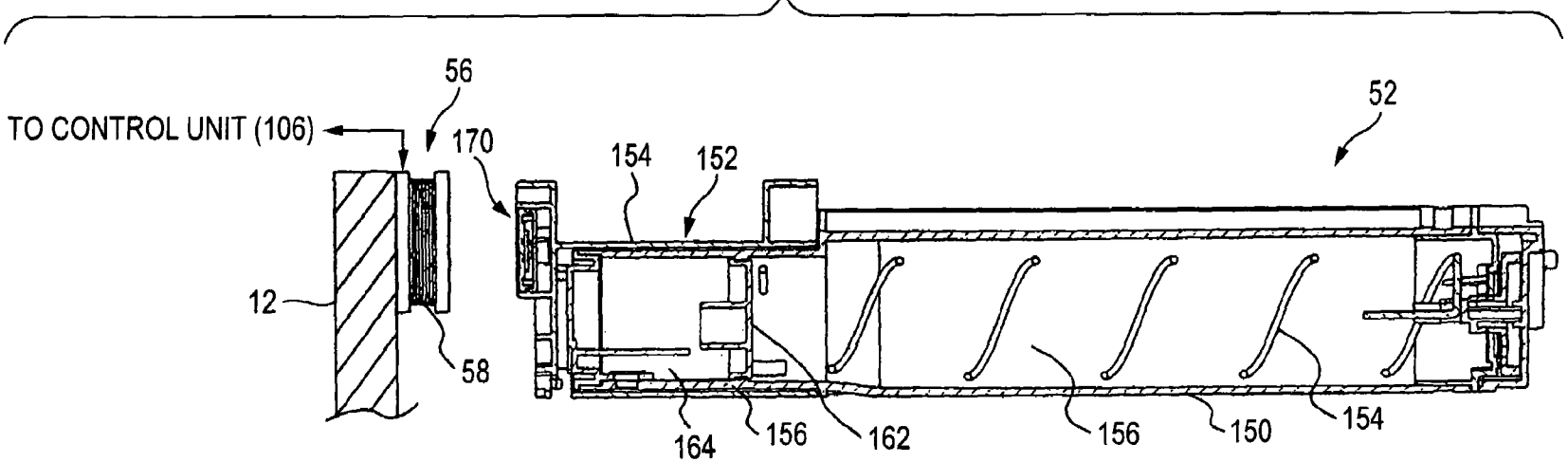
FIG. 10 is a sectional view illustrating a positional relationship between the wireless communication unit and the memory chip which perform wireless communication.

FIG. 10 illustrates a positional relationship between the wireless communication unit 56 and the memory chip 170 which perform wireless communication. As described above, the toner cartridge 52 is mounted in each developer container 48, and moves while the developer container unit 44 (FIG. 2) rotates about the rotating shaft 50. The wireless communication unit 56 is fixed to the image forming apparatus main body 12 in the vicinity of the lateral side of the developer container unit 44 so as to sequentially substantially face the memory chips 170 moved by the rotation of the developer container unit 44. The wireless communication unit 56 is also adapted to perform wireless communication in its halting state in which the movement of the developer container 48 is controlled at a position which substantially faces any one of the memory chips 170 so as to perform wireless communication with the facing memory chip 170. Further, the wireless communication unit 56 is adapted to receive acknowledge signals transmitted by the memory chip 170 in response to, for example, radio signals output by the wireless communication unit 56, so as to confirm the start of transmission or reception of data.

Figure 11:
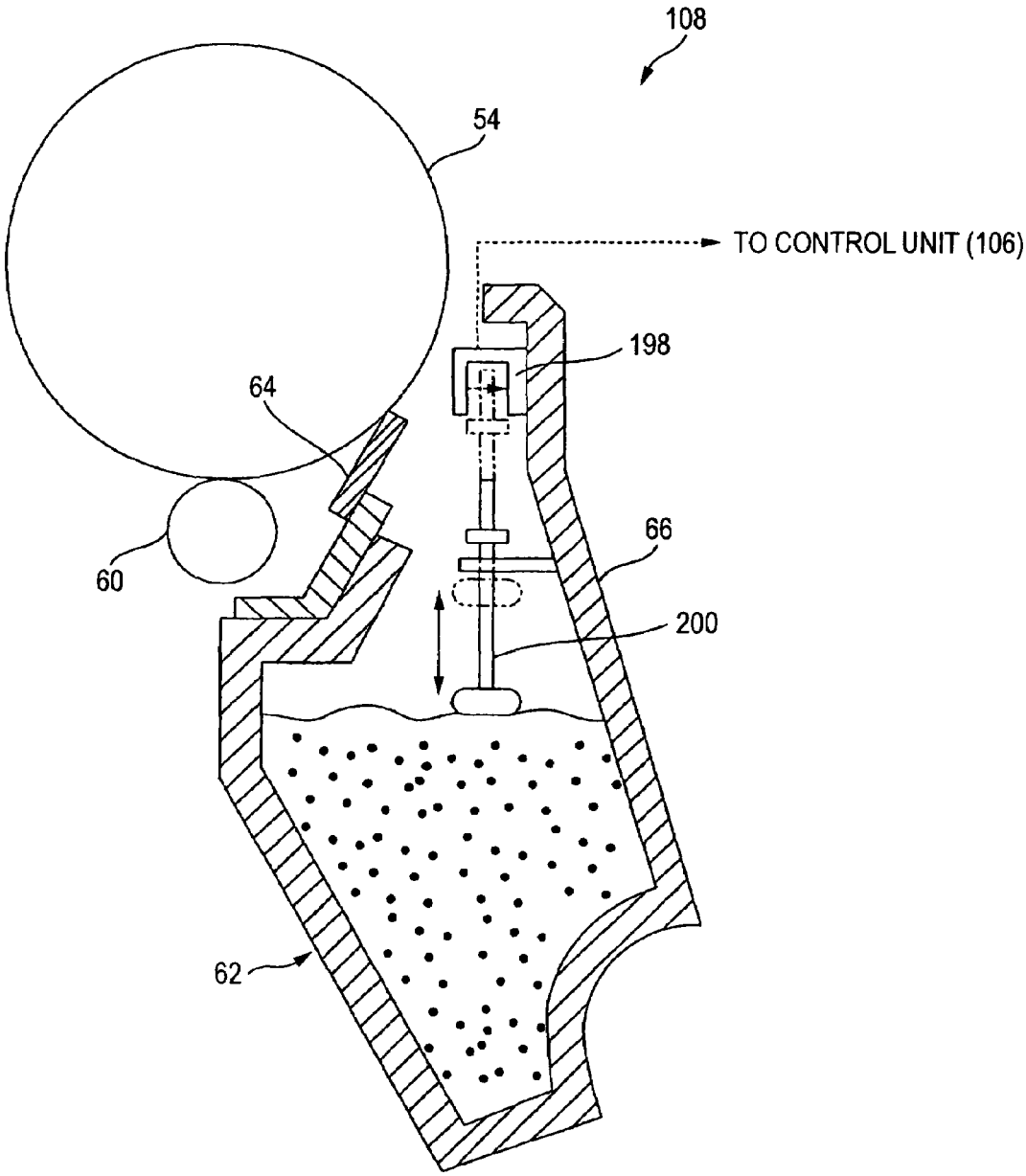
FIG. 11 is a side view illustrating a construction of an image carrier unit used for the image forming apparatus according to the embodiment of the present invention.

FIG. 11 illustrates a configuration of the image carrier unit 108 that is a replaceable unit.

As describe above, the image carrier unit 108 is constructed by integrating the image carrier 54, the electrifying device 60 and the image carrier cleaner 62 with each other. For example, the image carrier unit 108 has a waste toner fullness sensor 198 arranged in the image carrier cleaner 62 at the upper portion thereof, and a float 200 arranged below the waste toner fullness sensor 198. The waste toner fullness sensor 198 has an optical path configured such that light emitted by a light-emitting part provided at one side is received by a light-receiving part provided at the other side, and outputs whether or not the light-receiving part has received the light, to the control unit 106. The float 200 is adapted to rise when a waste toner collected in the waste toner collecting bottle 66 from the image carrier 54 exceeds a predetermined amount, and is adapted to intercept the optical path of the waste toner fullness sensor 198 when the waste toner collecting bottle 66 is full of a waste toner. As such, the image carrier unit 108 detects whether or not the waste toner collecting bottle 66 becomes full by means of the waste toner fullness sensor 198 and the float 200, and outputs the detected result to the control unit 106.

Further, the waste toner fullness sensor 198 and the float 200 may be provided in the cleaner 92 for an intermediate transfer body to detect whether or not the waste toner collecting bottle 98 becomes full.

As such, a replaceable unit which has a sensor or the like for detecting predetermined conditions is adapted to output results detected by the sensor or the like to the control unit 106, and the control unit 106 controls the respective components which constitute the image forming apparatus 10 on the basis of the input detected results.

Next, a construction of the control unit 106 will be described in detail.

Figure 12:
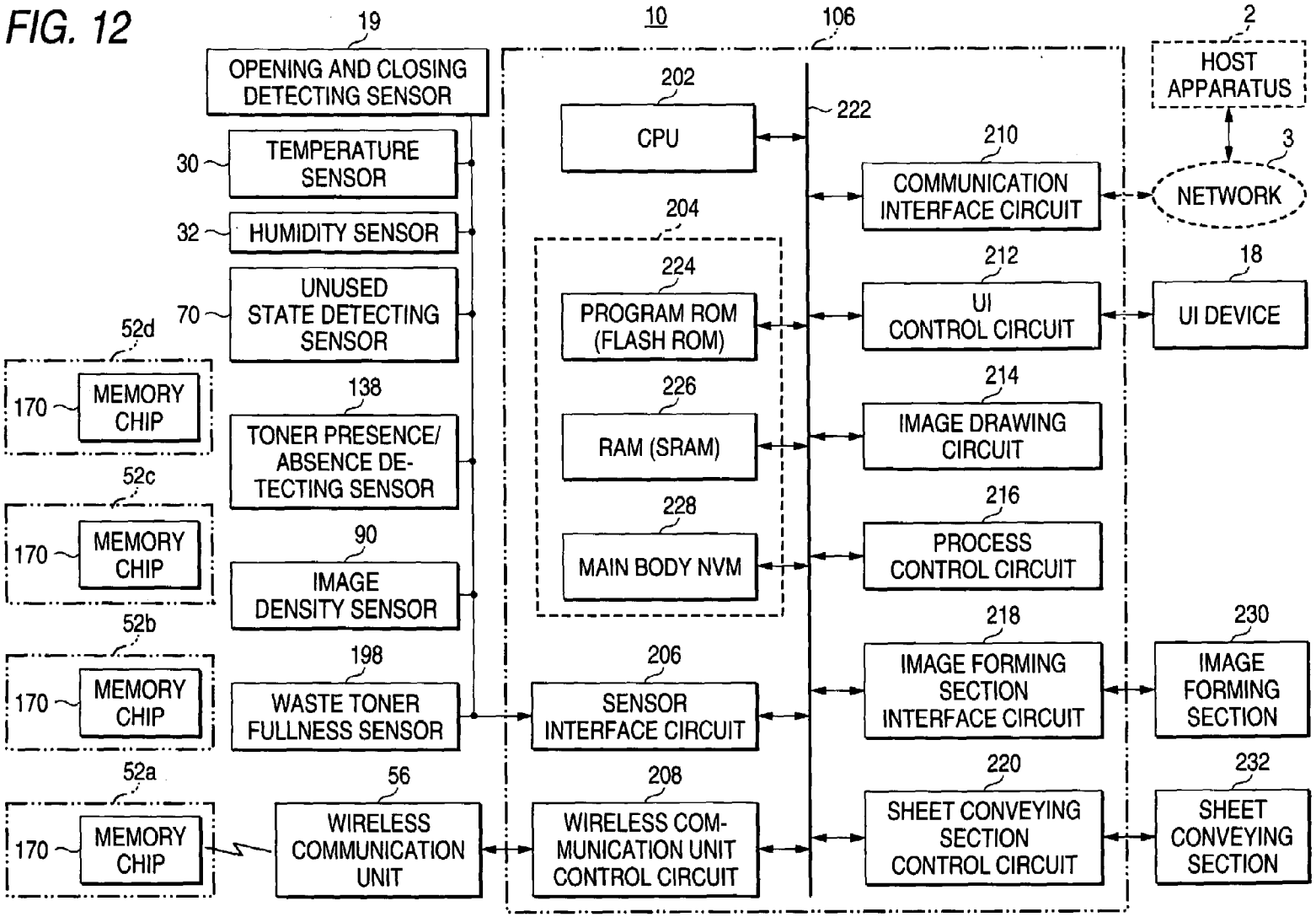
FIG. 12 is a block diagram showing a configuration of a control unit of the image forming apparatus according to the embodiment of the present invention, and respective components connected to the control unit.

FIG. 12 is a block diagram showing a configuration of the control unit 106 and respective components connected to the control unit 106.

The control unit 106 has a CPU 202, a storage unit 204, a sensor interface (sensor I/F) circuit 206, a wireless communication unit control circuit 208, a communication interface (communication I/F) circuit 210, a user interface (UI) control circuit 212, an image drawing circuit 214, a process control circuit 216, an image forming section interface (image forming I/F) circuit 218, and a sheet conveying section control circuit 220. These components are configured to be capable of inputting or outputting signals via a system bus 222.

The CPU 202 transmits or receives signals between the respective components, which constitute the control unit 106, via the system bus 222, and controls the respective components which constitute the control unit 106.

The storage unit 204 has a program ROM 224, a RAM 226 and a main body nonvolatile memory (NVM) 228, and stores information required for controlling the image forming apparatus 10, and the like. The program ROM 224 may have, for example, a flash ROM, and the contents stored in the program ROM 224 may be updated. The RAM 226 may have, for example, an SRAM, and stores temporary information, such as drawing data inputted from the image drawing circuit 214. The main body NVM 228 has, for example, an electrically rewritable nonvolatile memory, such as an EEPROM or a flash ROM. Meanwhile, the main body NVM 228 is a rewritable storage device, and it may be an SRAM, a hard disc drive (HDD) or an optical memory whose power is backed up by, for example, a battery, as long as it can hold data even if the image forming apparatus 10 is powered off.

The sensor I/F circuit 206 receives results detected by the opening and closing detecting sensor 19, the temperature sensor 30, the humidity sensor 32, the unused state detecting sensor 70, the toner presence/absence detecting sensor 138, the image density sensor 90 and the waste toner fullness sensor 198, respectively, and outputs the detected results to the CPU 202 via the system bus 222. The wireless communication unit control circuit 208 transmits or receives signals with the four memory chips 170 respectively provided in the toner cartridges 52*a* to 52*d* via the wireless communication unit 56, transmits or receives signals with the CPU 202, the storage unit 204 and the like, via the system bus 222, and connects the respective memory chips 170 with the CPU 202, storage unit 204 and the like.

The communication I/F circuit 210 transmits or receives signals with the host apparatus 2 via the network 3, transmits or receives signals with the CPU 202 and the like via the system bus 222, and connects the host apparatus 2 with the CPU 202 and the like. The UI control circuit 212 transmits or receives signals with the UI device 18, transmits or receives signals with the CPU 202 and the like via the system bus 222, and connects the UI device 18 with the CPU 202 and the like.

The image drawing circuit 214 draws an image on the basis of image forming signals inputted from the host apparatus 2 or the like, and outputs the drawn image to the CPU 202 and the RAM 226. The process control circuit 216 along with the CPU 202 refers to set values, which will be described later, stored in the storage unit 204, and controls an image forming section 230, including the exposure device 68, the image forming unit 110, the developer container unit 44 and the like, via the image forming section I/F circuit 218. The sheet conveying section control circuit 220 along with the CPU 202 controls a sheet conveying section 232, including the feeding roller 26, the retard roller 28, the resist roller 38 and the like.

Meanwhile, since the CPU 202 can compare the data stored in the storage unit 204 with the data stored in the unit NVM 184, and then determine the state of the toner cartridge 52 having the memory chip 170 thereto, the memory chip 170 constitutes a part of detecting unit, even if it does not have any sensor.

Next, data that is stored in the program ROM 224, the main body NVM 228 and the unit NVM 184 will now be described in detail.

Figure 13:
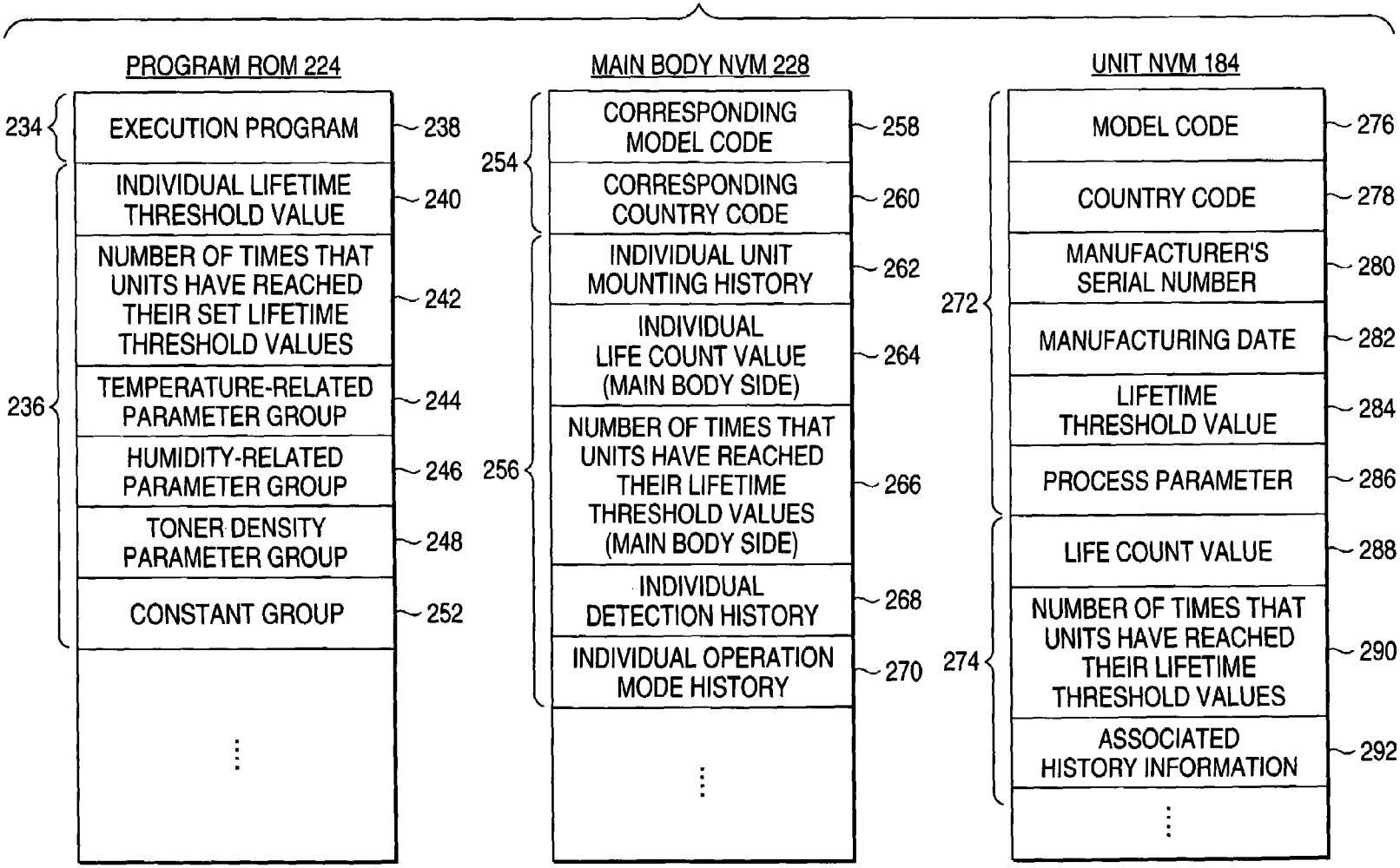
FIG. 13 is a memory map exemplifying data stored in a program ROM, a main body NVM and a unit NVM.

FIG. 13 illustrates an example of the data stored in the program ROM 224, the main body NVM 228 and the unit NVM 184.

The program ROM 224 is provided with a program region 234, a set value region 236, and the like. The program region 234 stores an execution program 238 for operating the image forming apparatus 10. The set value region 236 stores individual lifetime threshold values 240, number of times that units reached their set lifetime threshold values 242, a temperature-related parameter group 244, a humidity-related parameter group 246, a toner density parameter group 248, and determination timing set values 252.

The individual lifetime threshold values 240 include the lifetime (lifetime threshold values) of individual replaceable units of the image forming apparatus 10. The number of times that units have reached their set lifetime threshold values 242 include the number of times which allows the individual replaceable units of the image forming apparatus 10 to arrive at individual threshold values thereof. The temperature-related parameter group 244 includes individual parameters related to the control of the temperature of the image forming apparatus 10. The humidity-related parameter group 246 includes individual parameters related to the control of the humidity of the image forming apparatus 10. For example, a group of constants 252 include a capacity of the tubular part 156 of the toner cartridge, a capacity of the take-in conveying path 128 of the developer container 48, a capacity of the developer conveying paths 130 and 132, and a position of the toner presence/absence detecting sensor 138 (i.e. an interval from the toner receiving port 134) that are used for controlling the image forming apparatus 10.

The main body NVM 228 is provided with a corresponding unit information region 254 and a main-body-side update region 256, and the like.

The corresponding unit information region 254 stores corresponding model codes 258 and corresponding country codes 260. The corresponding model codes 258 store a table (data) of models showing whether each of the individual replaceable units of the image forming apparatus 10 is a model which matches with the image forming apparatus 10. The corresponding country codes 260 store a table (data) of individual countries which sets specifications different in each country for the individual replaceable units of the image forming apparatus 10.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. Further, a value showing that a genuine article is mounted is stored in an initial state (as an initial value) of each of the individual unit mounting histories 262. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10. The individual operation mode histories 270 include histories of operation modes applied to individual replaceable units of the image forming apparatus 10.

The unit NVM 184 is provided with a unit information region 272, a unit-side update region 274, and the like.

The unit information region 272 stores model codes 276 indicating a model, country codes 278 indicating a country in which the specification of a model is set, manufacturer's serial numbers 280 and manufacturing dates 282, which are unique to the individual units, lifetime threshold values 284 indicating lifetime of the unit, process parameters 286 for process control, and the like.

The unit-side update region 274 stores life count values 288 showing the consumption of the toner cartridge 52 up to the present time from the time when the toner cartridges being to be used, number of times that units have reached their lifetime threshold values 290 showing the number of times which arrives at a lifetime threshold value stored in the lifetime threshold values 284, associated history information 292, and the like. Meanwhile, the associated history information 292 includes histories of associated information, such as the number of revolutions of the image carrier 54, available for grasping the state of the toner cartridge 52.

When image forming signals are transmitted to the image forming apparatus 10 constructed as above, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at its development position by the developer container unit 44. In the developer container unit 44, the developer containers 48*a* to 48*d* are respectively supplied with yellow, magenta, cyan and black toners from the toner cartridges 52*a* to 52*d*. Further, developers excessively supplied to the developer containers 48*a* to 48*d* are respectively collected into the toner cartridges 52*a* to 52*d*. The toner images developed for each color by the developer containers 48*a* to 48*d* of the developer container unit 44 are superposed on the intermediate transfer body 74 to be primarily transferred thereto. At the time of the primary transfer, a waste toner remaining on the image carrier 54 is scraped and collected by the cleaner 62 for an image carrier.

On the other hand, upon receiving sheet feeding signals or the like, sheets received in the sheet feeding cassette 24 are fed by the feeding roller 26, are separated by the retard roller 28, and are guided to the conveying path 34, are then primarily stopped by the resist roller 38, and are guided to between the secondary transfer roller 88 and the secondary transfer backup roller 82 at a predetermined timing. When the sheet is guided to between the secondary transfer roller 88 and the secondary transfer backup roller 82, a toner image on which four colors overlap each other by the primary transfer onto the intermediate transfer body 74 is secondarily transferred on the sheet by the secondary transfer roller 88 and the secondary transfer backup roller 82. After the secondary transfer, a waste toner remaining on the intermediate transfer body 74 is scraped by the cleaner 92 for an intermediate transfer body, and is then collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40. The control unit 106 makes a life count value or the like of the toner cartridge 52 stored in the unit NVM 184 and the main body NVM 228.

Figure 14:
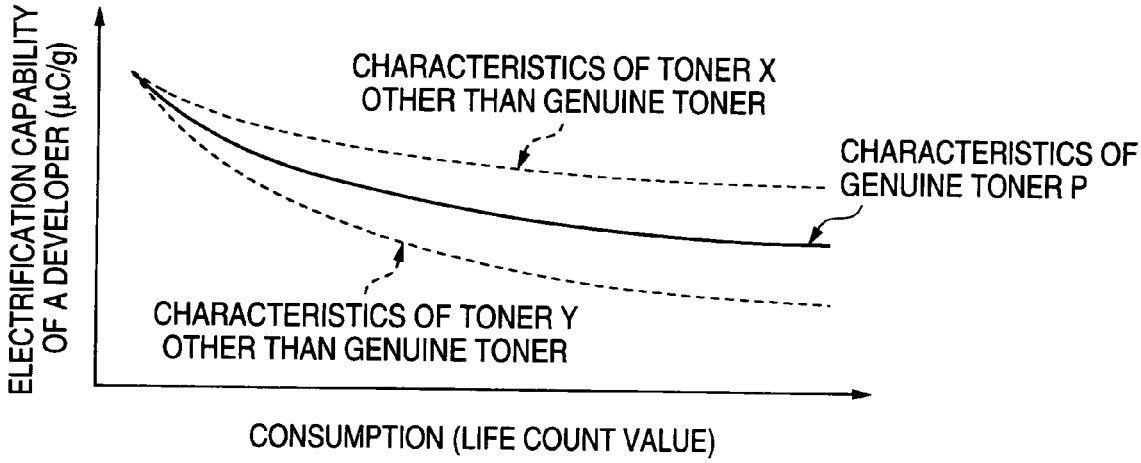
FIG. 14 is a graph showing a change in the electrification capability of a developer with respect to consumption (a life count value) stored in the main body NVM.

FIG. 14 is a graph showing a change in the electrification capability of a developer with respect to the consumption (life count value) of the developer stored in the main body NVM 228.

Figure 15:
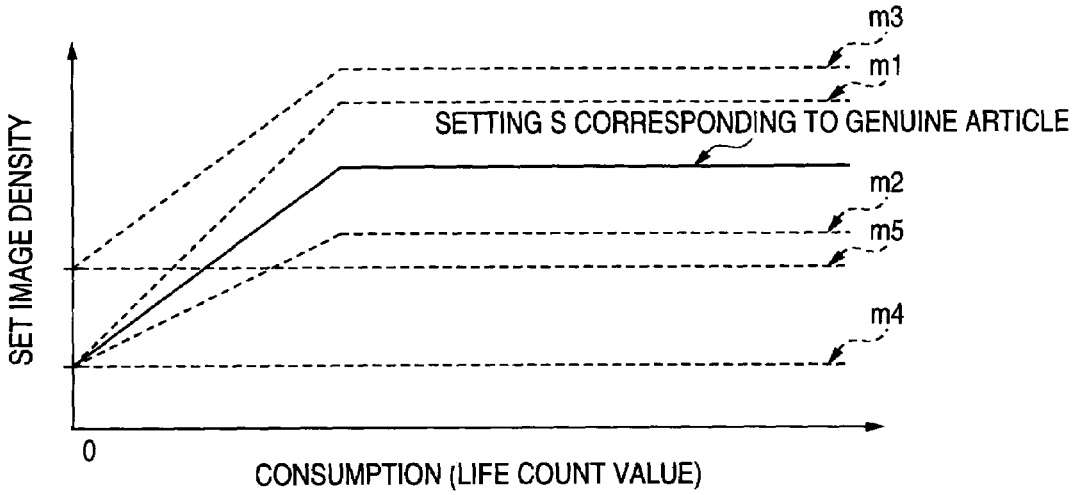
FIG. 15 is a graph showing setting for correcting a change in the electrification capability of the developer, which shows setting of an image density with respect to the consumption of the developer.

FIG. 15 is a graph showing setting for correcting a change in the electrification capability of the developer, which shows setting of an image density with respect to the consumption of the developer.

Figure 16A:
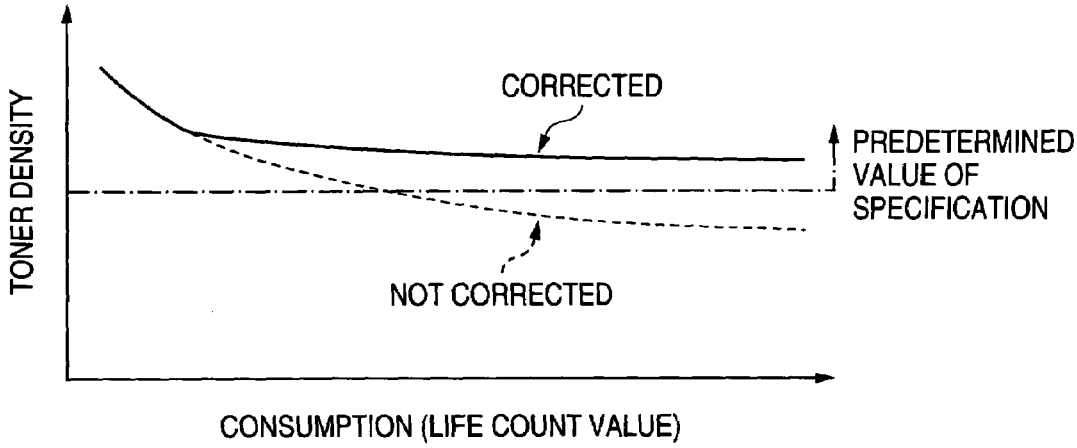
Figure 16B:
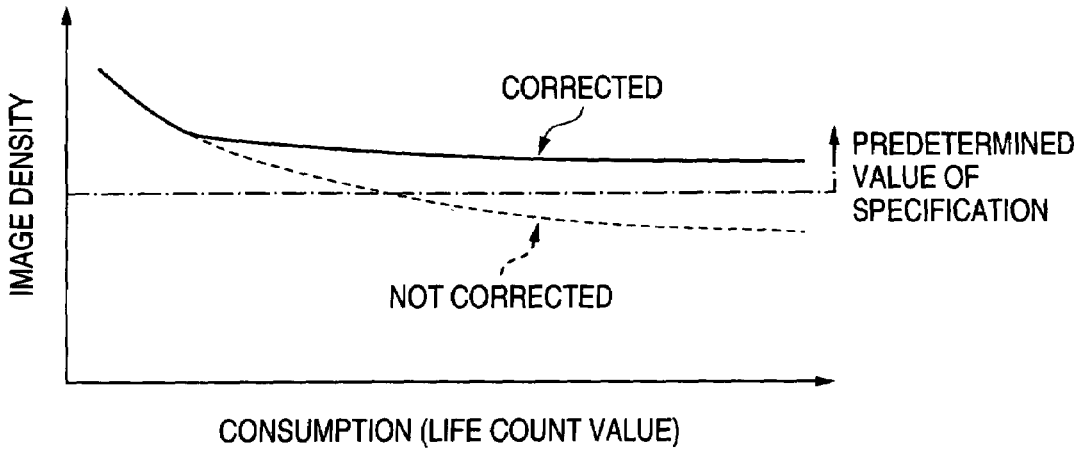

FIGS. 16A and 16B are graphs showing results corrected by the setting shown in FIG. 15, in which FIG. 16A shows a corrected toner density, and FIG. 16B shows a corrected image density.

A toner accommodated in the toner cartridge 52 is frictionally electrified so as to have predetermined polarity and electric charge quantity by a carrier in the developer container 48. When a developer is used, the electrification capability of the developer deteriorates according to the consumption of the developer, like characteristics of a genuine toner P shown in FIG. 14.

Thus, even when the image forming apparatus 10 employs a trickle development method, in order to maintain the image quality of an image formed on a sheet at a predetermined level, the setting on the density of a toner in the developer container 48 and the density of an image on the intermediate transfer body 74 should be corrected.

For example, the CPU 202 makes the image density sensor 90 detect the density of an image. At this time, if the image density is high, the CPU 202 controls the rotational drive of the first auger 118 to reduce the amount of a toner to be supplied into the developer container 48, thereby lowering the density of the toner, which lowers the density of the image. Further, if the image density is low, the CPU 202 controls the rotational drive of the first auger 118 to increase the amount of a toner to be supplied into the developer container 48, thereby raising the density of the toner, which raises the density of the image. Generally, a pattern having half-tone density is used as a pattern for detecting the above-mentioned image density.

However, when the electrification capability of a toner deteriorates, the development performance of the toner is improved and the image density is raised. Therefore, if the above-mentioned control is executed as it is, the toner density may be excessively lowered, which may lower a maximum image density.

Accordingly, even when the electrification capability of a developer deteriorates, in order for the maximum density of an image transferred onto a sheet not to be lowered, the set values for controlling the density of a toner in the developer container 48, which are stored in the toner image parameter group 248 used for controlling the toner density based on the image density detection results detected by the image density sensor 90, are corrected to increase according to the consumption of the developer. The CPU 202 makes the first auger 118 rotate according to the corrected set values (setting S corresponding to the toner P in FIG. 15) so that the toner density can be maintained so as not to be below a desired predetermined value, as shown in FIG. 16A.

As a result, as shown in FIG. 16B, the image density can be maintained so as not to be below a specified set value.

On the other hand, in case a toner cartridge other than a genuine cartridge, which contains a toner X or a toner Y other than a genuine toner P for the image forming apparatus 10 and has substantially the same construction as that of the toner cartridge 52, is mounted, as shown in FIG. 14, it is expected the toner X or the toner Y will exhibit characteristics different from those of the genuine toner P. Thus, in order to improve the quality of an image to be formed on a sheet, corrected set values different from the setting S corresponding to the toner P are required. Accordingly, for example, in the case of any cartridge other than a genuine cartridge, which contains the toner X or the toner Y, correction is made to the consumption of a developer obtained by combining conditions to be changed, such as increasing or decreasing the degree of a change (gradient) in a set value of the toner density (m1 or m2 in FIG. 15); increasing or decreasing a limit value (m1 or m2); varying an initial value (consumption=0) (m3); no making a change in a set value according to the consumption (m4); and no making a change in a set value according to the consumption, for example, by varying an initial value (m5). This change is performed by allowing a user to select an operation mode other than that corresponding to the genuine toner via the UI device 18.

Next, a method of controlling the image forming apparatus 10 based on the data stored in the storage unit 204 and the unit NVM 184 will now be described.

Figure 17:
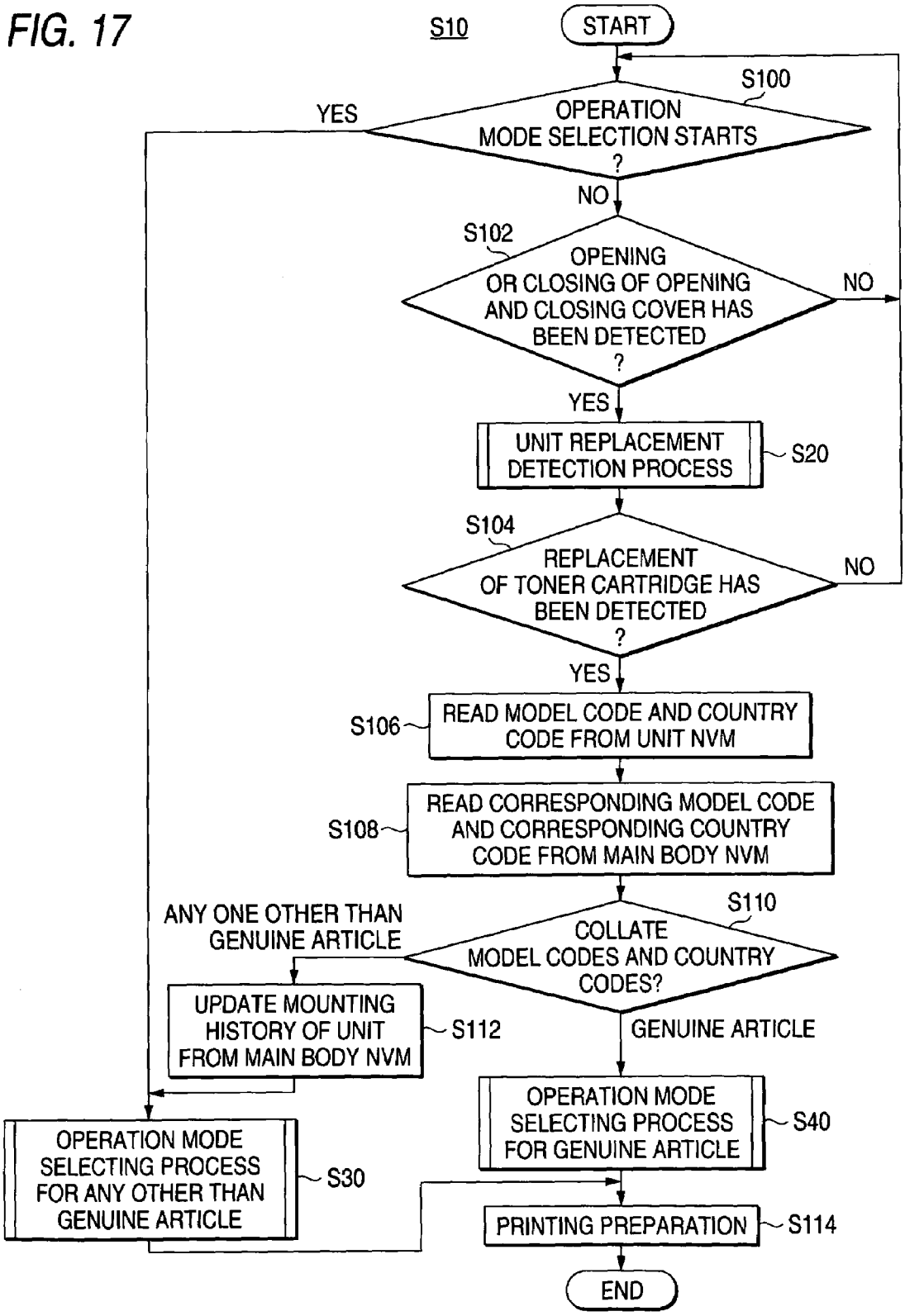
FIG. 17 is a flowchart showing a process (S10) in which the image forming apparatus performs printing preparation on a toner cartridge, which is fit to an operation mode.

FIG. 17 is a flowchart showing a process (S10) in which the image forming apparatus 10 performs printing preparation on the toner cartridge 52, which is fit for an operation mode.

Figure 18:
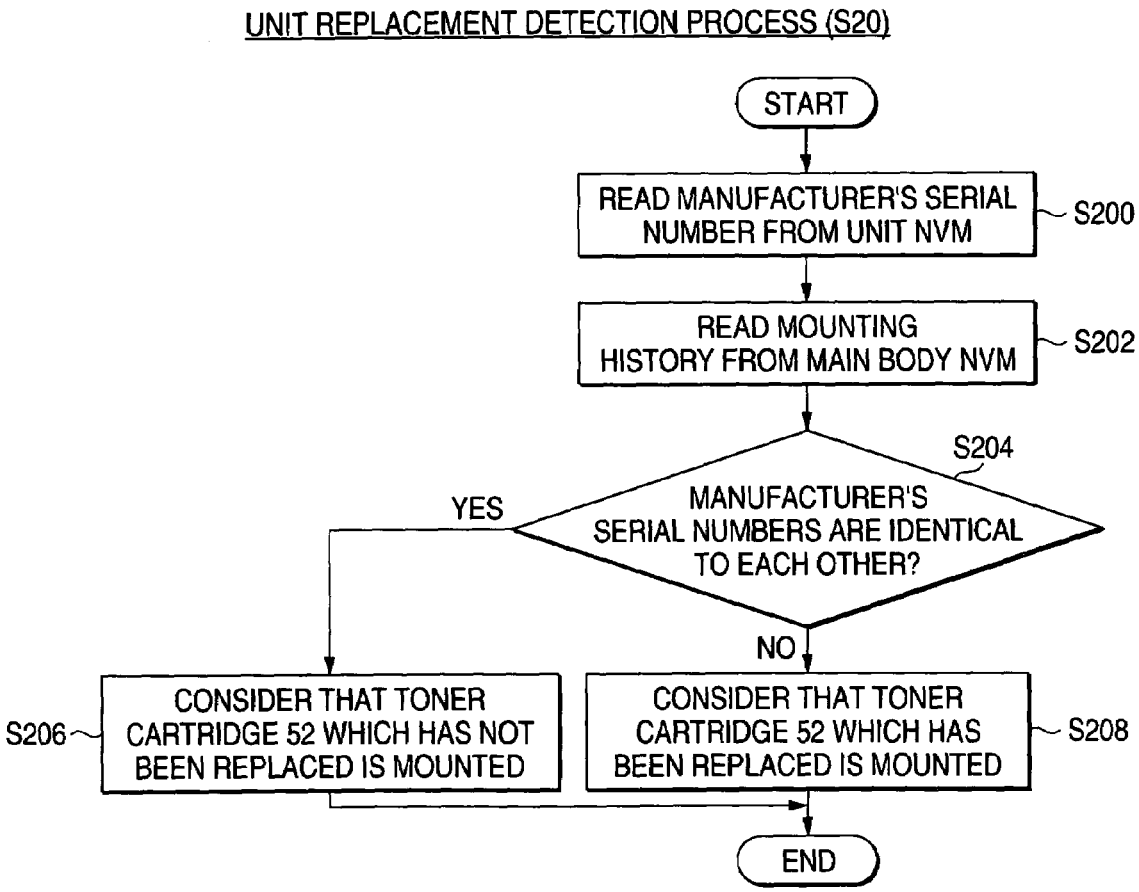
FIG. 18 is a flowchart showing a unit replacement detecting process (S20) of detecting whether or not a toner cartridge has been replaced.

FIG. 18 is a flowchart showing a unit replacement detecting process (S20) of detecting whether or not the toner cartridge 52 has been replaced.

Figure 19:
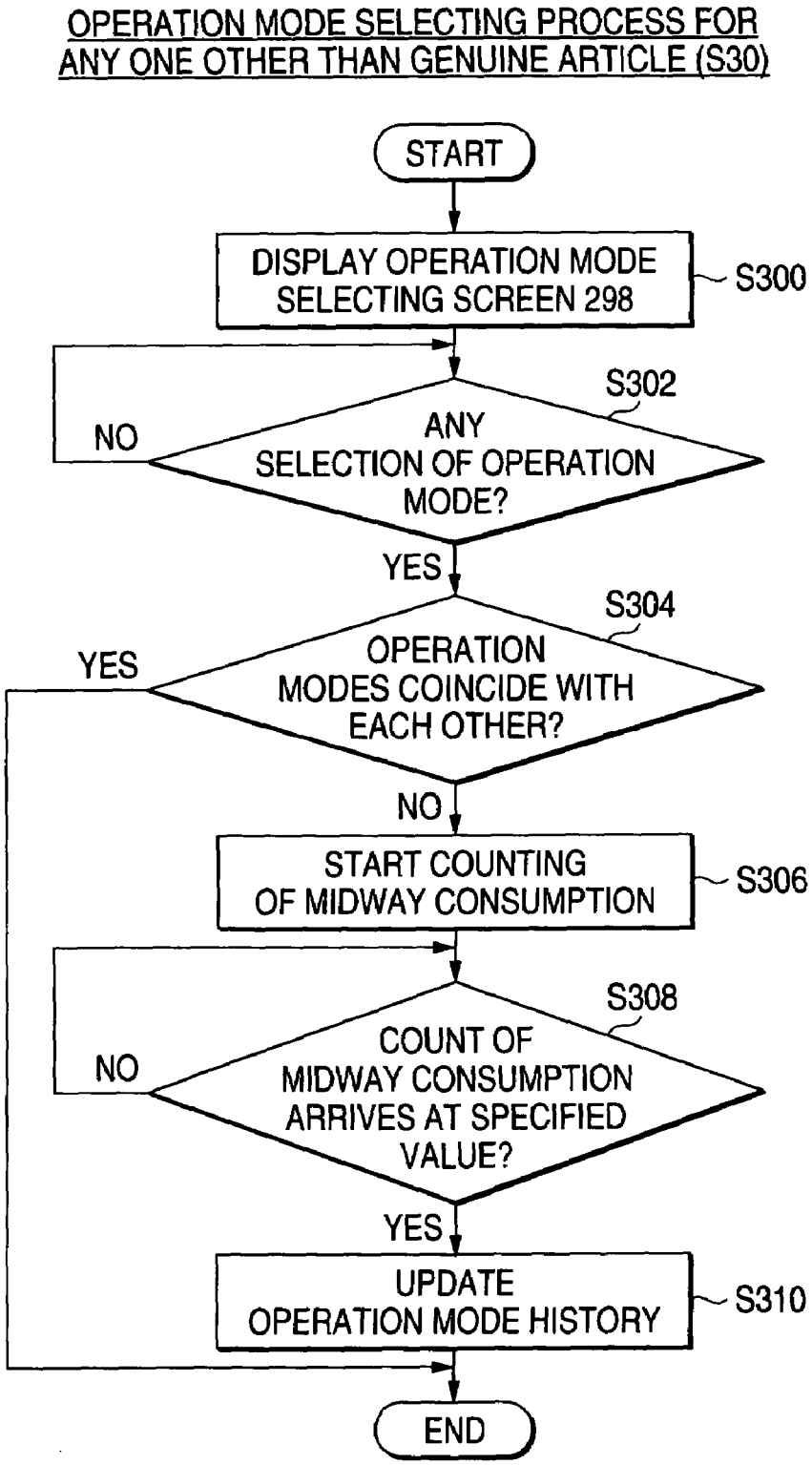
FIG. 19 is a flowchart showing an operation mode selecting process for any one other than a genuine article (S30), performed by the image forming apparatus so that a user can select an operation mode for any one other than the genuine article.

FIG. 19 is a flowchart showing an operation mode selecting process for any one other than a genuine article (S30), performed by the image forming apparatus 10 so that a user can select an operation mode for any one other than the genuine article.

Figure 20:
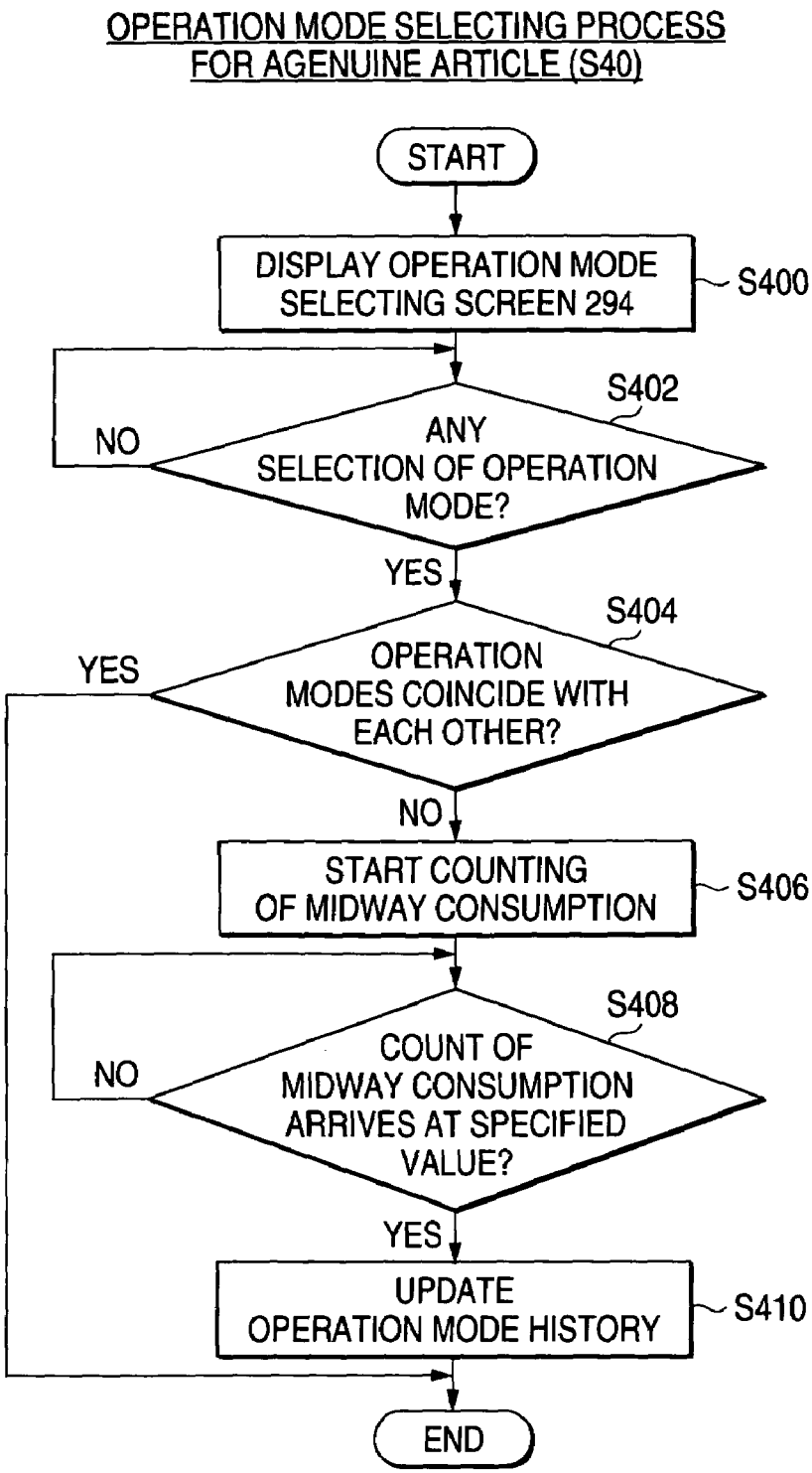
FIG. 20 is a flowchart showing an operation mode selecting process for a genuine article (S40) performed by the image forming apparatus so that a user can select an operation mode for the genuine article.

FIG. 20 is a flowchart showing an operation mode selecting process for a genuine article (S40) performed by the image forming apparatus 10 so that a user can select an operation mode for the genuine article.

As shown in FIG. 17, in Step 100 (S100), the CPU 202 determines whether or not there is any input for starting the selection of an operation mode by operating the UI device 18. If there is any input for starting the selection of an operation mode, the process in S30 is carried out, whereas if there is no input for starting the selection of an operation mode, a process in S102 is carried out.

In Step 102 (S102), the CPU 202 determines whether the opening and closing detecting sensor 19 has detected opening or closing of the opening and closing cover 16. If the CPU 202 determines that the opening or closing of the opening and closing cover 16 has been detected, a process in S20 is carried out. If not, a process in S100 is carried out. In other words, if the opening and closing cover 16 is opened or closed, since there is possibility that the toner cartridge 52 has been replace, a unit replacement detecting process is carried out.

In Step 200 (S200 in FIG. 18), the CPU 202 reads the manufacturer's serial number 280 from the unit NVM 184.

In Step 202 (S202), the CPU 202 reads a manufacturer's serial number of a last-mounted toner cartridge, which is included in the individual unit mounting histories 262 from the main body NVM 228.

In Step 204 (S204), the CPU 202 determines whether or not the manufacturer's serial number of the last-mounted cartridge is identical to the manufacturer's serial number 280 read from the unit NVM 184. If the manufacturer's serial number of the last-mounted toner cartridge is identical to the manufacturer's serial number 280 read from the unit NVM 184, a process in S206 is carried out. If not, a process in S208 is carried out.

In Step 206 (S206), the CPU 202 considers that the toner cartridge 52 which has not been replaced is again mounted (that the toner cartridge is not replaced).

In Step 208 (S208), the CPU 202 considers that a toner cartridge 52 which has been replaced is mounted (that the replacement is detected).

In Step 104 (S104 in FIG. 17), if the CPU 202 considers that the replacement of the toner cartridge 52 is detected, a process in S106 is carried out. If not, the process in S100 is carried out.

In Step 106 (S106), the CPU 202 reads a model code 276 and a country code 278 from the unit NVM 184.

In Step 108 (S108), the CPU 202 reads a corresponding model code 258 and a corresponding country code 260 from the main body NVM 228.

In Step 110 (S110), the CPU 202 collates the model code 276 with the corresponding model code 258, and collates the model code 278 with the corresponding country code 260. At this time, if the CPU 202 determines that a replaced toner cartridge 52 is genuine, a process in S40 is carried out, whereas if the CPU 202 determines that the replaced toner cartridge 52 is not genuine, a process in S112 is carried out.

In Step 112 (S112), in accordance with data read from a toner cartridge 52 which is currently mounted, the CPU 202 updates the mounting history of the toner cartridge 52 included in the individual unit mounting histories 262 of the main body NVM 228. Then, the process in S30 is carried out.

Figure 21A:
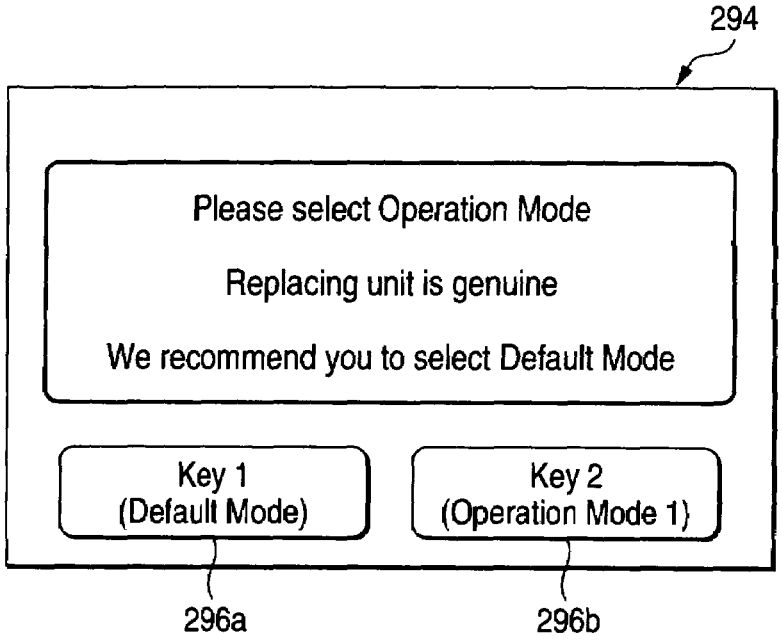
Figure 21B:
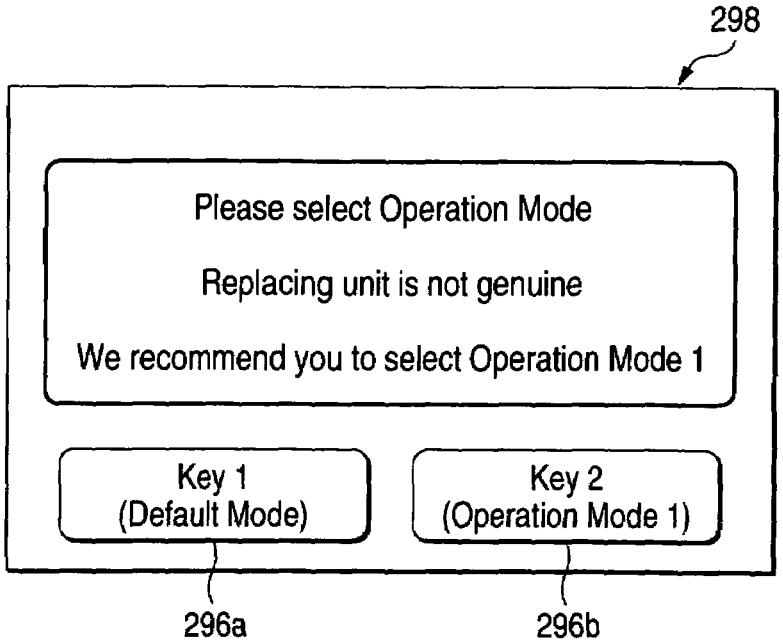

In Step 300 (S300 in FIG. 19), the UI device 18 displays an operation mode selecting screen 298 shown in FIG. 21B.

In Step 302 (S302), the CPU 202 determines whether or not an input has been finished which selects either a key button 296*a* for selecting a default mode (an operation mode corresponding to a genuine article) displayed on the operation mode display screen 298, or a key button 296*b* for specifying the other operation modes. If the input which selects any one of the key buttons 296*a* and 296*b* has been finished, a process in S304 is carried out. If there is no input for specifying any one of the operation modes, the image forming apparatus 10 waits until a user selects any operation mode.

In Step 304 (S304), the CPU 202 determines whether an operation mode stored in the individual operation mode histories 270 of the main body NVM 228 coincides with the operation mode selected in the process in S302. If both the operation modes do not coincide with each other, a process in S306 is carried out. If both the operation modes coincide with each other, the process in S30 is finished.

In Step 306 (S306), the CPU 202 starts counting of a midway consumption of a toner representing the consumption of the toner used after the process in S306. Meanwhile, the midway consumption is different from the life count value (the consumption up to the present time from the beginning to use), and is counted from, for example, zero in the process in S306. Further, the midway consumption is calculated by the CPU 202 from, for example, the number of revolutions of the first auger 118.

In Step 308 (S308), the CPU 202 determines whether or not the count of the midway consumption started by the process in S306 arrives at a specified value. If the count arrives at the specified value, a process in S310 is carried out. If the count does not arrive at the specified value, the counting of the midway consumption continues. Meanwhile, the specified value used in the process in S308 is obtained by calculating the amount of a toner before replacement of the toner cartridge 52, which remains in, for example, the take-in conveying path 128 or the like of the developer container 48, from the capacity or the like of the take-in conveying path 128 stored in a constant group (i.e., a group of constants) 252 of the program ROM 224.

In Step 310 (S310), the CPU 202 updates the individual operation mode histories 270 of the main body NVM 228 with an operation mode selected in S302.

In Step 400 (S400 in FIG. 20), the UI device 18 displays the operation mode selecting screen 294 shown in FIG. 21A.

In Step 402 (S402), the CPU 202 determines whether or not an input has been finished which selects either the key button 296*a* for selecting a default mode (an operation mode corresponding to a genuine article) displayed on the operation mode display screen 294, or the key button 296*b* for specifying the other operation modes. If the input which selects any one of the key buttons 296*a* and 296*b* has been finished, a process in S404 is carried out. If there is no input for specifying any one of the operation modes, the image forming apparatus 10 waits until a user selects any operation mode.

In Step 404 (S404), the CPU 202 determines whether an operation mode stored in the individual operation mode histories 270 of the main body NVM 228 coincides with the operation mode selected in the process in S402. If both the operation modes do not coincide with each other, a process in S406 is carried out. If both the operation modes coincide with each other, the process in S40 is finished.

In Step 406 (S406), the CPU 202 starts counting of a midway consumption of a toner representing the consumption of the toner used after the process in S406. Meanwhile, the midway consumption is different from the life count value (the consumption up to the present time from the beginning to use), and is counted from, for example, zero in the process in S406. Further, the midway consumption is calculated by the CPU 202 from, for example, the number of revolutions of the first auger 118.

In Step 408 (S408), the CPU 202 determines whether or not the count of the midway consumption started by the process in S406 arrives at a specified value. If the count arrives at the specified value, a process in S410 is carried out. If the count does not arrive at the specified value, the counting of the midway consumption continues. Meanwhile, the specified value used in the process in S408 is obtained by calculating the amount of a toner before replacement of the toner cartridge 52, which remains in, for example, the take-in conveying path 128 or the like of the developer container 48, from the capacity or the like of the take-in conveying path 128 stored in a constant group (i.e., a group of constants) 252 of the program ROM 224.

In Step 410 (S410), the CPU 202 updates the individual operation mode histories 270 of the main body NVM 228 with an operation mode selected in S302.

In Step 114 (S114 in FIG. 17), the CPU 202 performs printing preparation fit to a selected operation mode which is included in the latest individual operation mode histories 270, and then completes the process. Meanwhile, in the printing preparation in S114, for example, whether or not a mounted toner cartridge 52 is genuine may be displayed on the UI device 18.

Thus, in the image forming apparatus 10, even when a toner cartridge 52 is replaced and an operation mode is needed to be switched to other operation mode, the operation mode can be switched to the other operation mode after a toner remaining in the take-in conveying path 128 or the like before the replacement of the toner cartridge 52 is used up, and an image can be formed in an operation mode with optimum parameters before or after the replacement of the toner cartridge 52.

Meanwhile, the midway consumption of a toner may be calculated from the number of sheets printed.

Further, a plurality of other operation modes different from an operation mode corresponding to a genuine article may be provided so that a user can freely select any operation mode from the plurality of other operation modes.

As such, even when a replaceable unit of the image forming apparatus 10 is not genuine, a user can select any operation mode different from an operation mode corresponding to a genuine article so that the image quality can be improved.

Further, if replaceable units are all genuine, an operation mode which can be selected by a user is limited so that the image forming apparatus 10 operates only in operation modes corresponding to the genuine articles, thereby preventing the user from deteriorating the image quality inadvertently.

Second Embodiment

An image forming apparatus, an image forming system, and a method of controlling the image forming apparatus of the second embodiment includes configurations of the first embodiment that are explained by FIGS. 1 to 21. Therefore, in this embodiment, explanations of the overlapped configurations are omitted.

Figure 22:
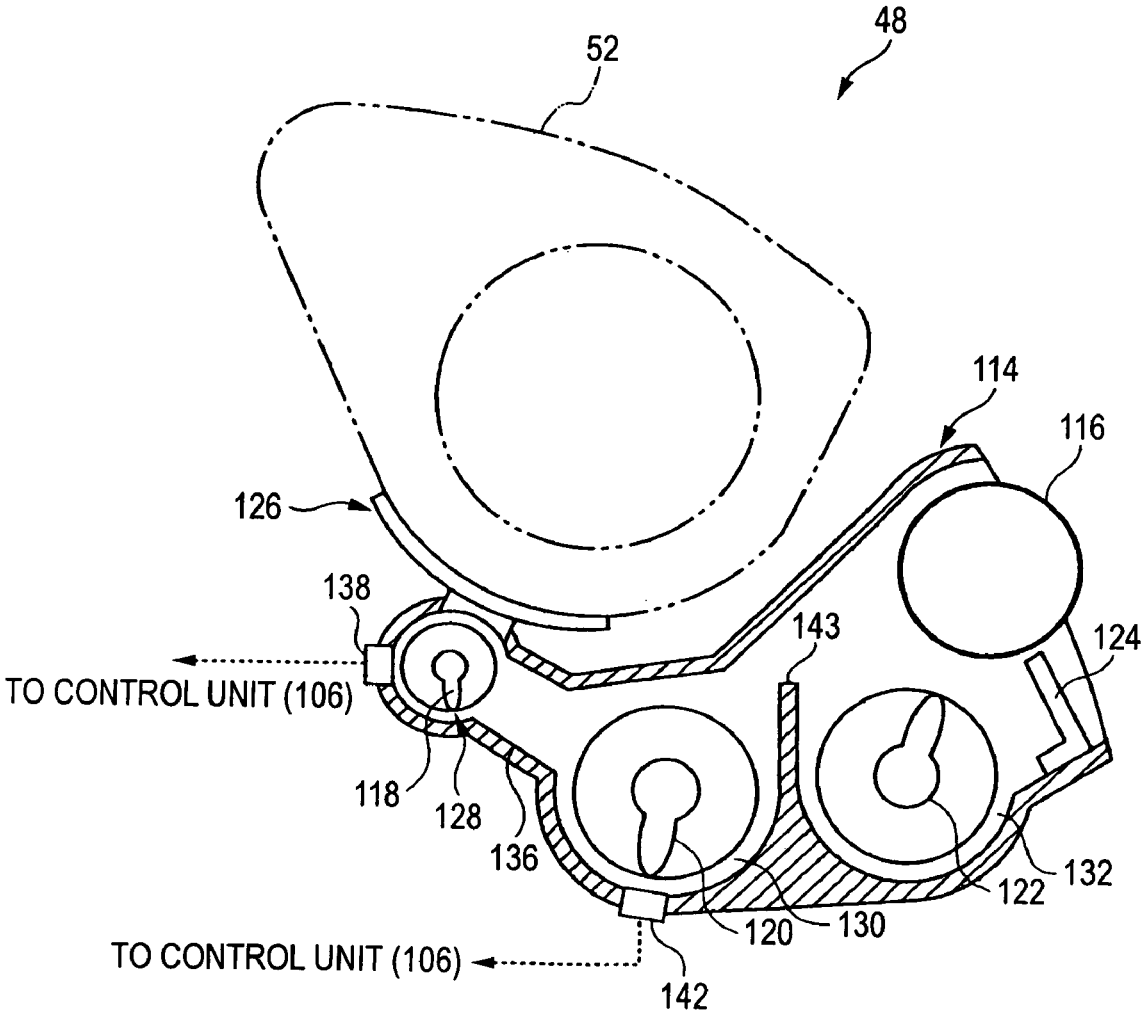
FIG. 22 is a schematic view illustrating a cross-section of the developer container of the image forming apparatus according to the embodiment of the present invention.

FIG. 22 is a schematic view illustrating a cross-section of the developer container of the image forming apparatus according to the embodiment of this embodiment.

Figure 23:
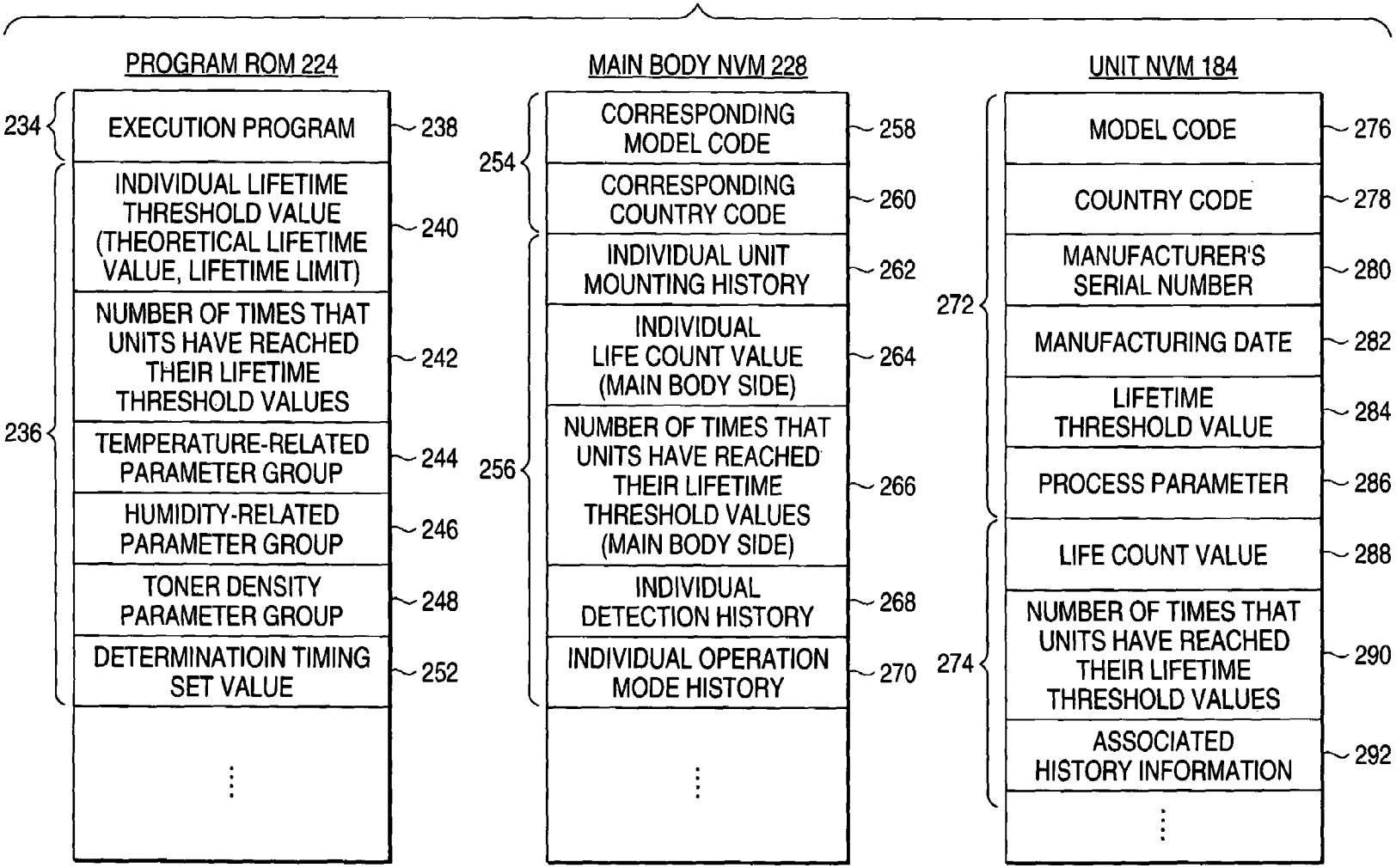
FIG. 23 is a memory map exemplifying data stored in a program ROM, a main body NVM and a unit NVM.

FIG. 23 is a memory map exemplifying data stored in a program ROM, a main body NVM and a unit NVM.

The lifetime threshold values include a theoretical lifetime value of the genuine unit (a first reference value) and a lifetime limit of the genuine unit (a second reference value). The theoretical lifetime value indicates an accumulating usable quantity (for example, an accumulation of the drive time, a multiple value of the pixel, and a number of the print, etc.) when used the genuine unit in an average using condition. The lifetime limit indicates a limit of an accumulation use quantity (for example, an accumulation of the drive time, a multiple value of the pixel, and a number of the print, etc.) which is set by considering a machine difference of the unit and a difference of a use condition of the unit. Besides, the accumulation use quantity includes use quantity at the other image forming apparatus in addition to the use quantity at the image forming apparatus 10 (for example, the accumulation of the drive time of the operation which supplies a toner, the multiple value of the pixel that is printed by the unit, and an accumulation number of rotations of the image carrier 54 or a number of the print, etc.).

The number of times that units have reached their set lifetime threshold values 242 include the number of times that allows the individual replaceable units of the image forming apparatus 10 to arrive at individual threshold values thereof. The temperature-related parameter group 244 includes individual parameters related to the control of the temperature of the image forming apparatus 10. The humidity-related parameter group 246 includes individual parameters related to the control of the humidity of the image forming apparatus 10. The toner density parameter group 248 includes individual parameters related to the control of the density of a toner in the developer container 48. The determination timing set values 252 include a period of time (determination timing) which is taken until the CPU 202 starts to determine whether or not the individual replaceable units of the image forming apparatus 10 are genuine in a process (FIG. 17) or the like in which the image forming apparatus 10 performs printing preparation fit to an operation mode, which will be described later.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10.

The individual operation mode histories 270 include histories of operation modes applied to individual replaceable units of the image forming apparatus 10. Meanwhile, the image forming apparatus 10 stores as an initial value of each of the individual operation mode histories 270 an operation mode (default mode S) corresponding to a genuine article, and when a user selects an operation mode, adds the selected operation mode. Further, when a user selects the same operation mode as the previous operation mode, the image forming apparatus 10 writes the selected operation mode on top of the previous operation mode.

Next, a mode switching module 500 which is stored in the program ROM 224 and constitutes a part of the execution program 238 will now be described.

Figure 24:
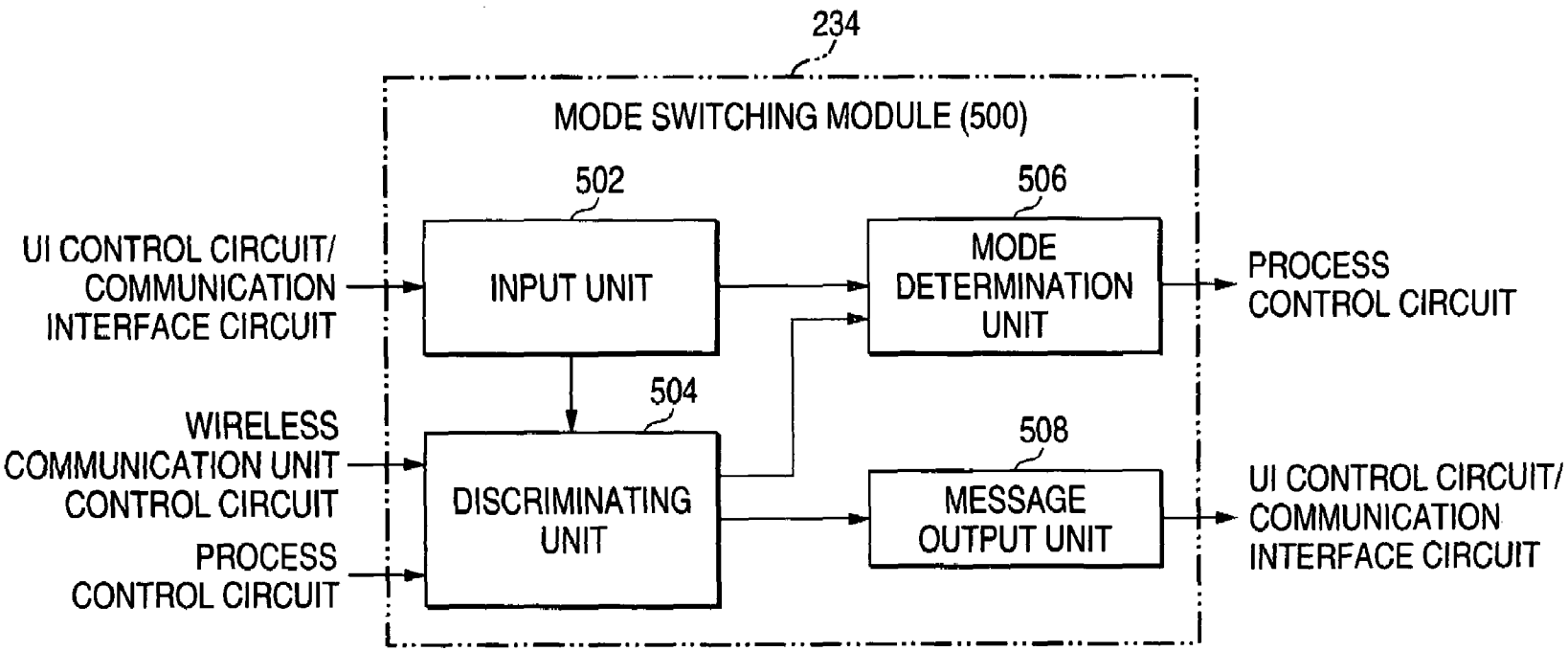
FIG. 24 shows a functional configuration of a mode switching module 500 which is stored in the program ROM 224, and constitutes a part of an execution program 238.

FIG. 24 illustrates a functional configuration of the mode switching module 500.

The mode switching module 500 has an input unit 502, a discriminating unit 504, a mode determination unit 506, and a message output unit 508.

The input unit 502 accepts user's selective operation of an operation mode, and notifies the mode determination unit 506 of the selected operation mode. Particularly, the input unit 502 acquires identification information on the operation mode selected by a user via the UI control circuit 212 (FIG. 12), and outputs the identification information on the acquired operation mode to the mode determination unit 506. Further, the input unit 502 accepts a supervisor's reply to a confirmation request message that the supervisor is requested to confirm whether or not a unit is genuine, and outputs the reply to the confirmation request message to the discriminating unit 504.

Meanwhile, the input unit 502 may accept the selective operation of the operation mode and the reply to the confirmation request message from the host apparatus 2 (FIG. 1) via the communication I/F circuit 210 (FIG. 12).

The discriminating unit 504 discriminates whether a mounted unit is a genuine article or any one other than the genuine article on the basis of information (for example, life count values, model codes or country codes) stored in the unit NVM 184, and outputs the discrimination results to the mode determination unit 506 and the message output unit 508. More particularly, the discriminating unit 504 discriminates whether a mounted unit is a genuine article or any one other than the genuine article on the basis of information (for example, life count values) on the consumption of the unit or information (for example, country codes) indicating a region where the unit is to be used, which are stored in the unit NVM 184. For example, the discriminating unit 504 calculates the cumulative consumption of a unit on the basis of the life count value 288 stored in the unit NVM 184, and compares the calculated cumulative consumption with the a theoretical lifetime value and a lifetime limit (an individual lifetime threshold value 240) stored in the program ROM 224. When the accumulative consumption exceeds the lifetime limit, the discriminating unit 504 discriminates that the mounted unit is any one other than a genuine unit, and when the accumulative consumption is below the theoretical lifetime value, the discriminating unit 504 discriminates that the mounted unit is a genuine unit. When the accumulative consumption is between the theoretical lifetime value and the lifetime limit, the discriminating unit 504 discriminates that the mounted unit is an unknown unit.

Further, the discriminating unit 504 compares a country code 278 stored in the unit NVM 184 with the corresponding country code 260 stored in the main body NVM 228. When the country code 278 corresponds to the corresponding country code 260, the discriminating unit 504 discriminates that the mounted unit is a genuine unit, whereas when they does not correspond to each other, the discriminating unit 504 discriminates that the mounted unit is any one other than a genuine unit. In other words, the discriminating unit 504 discriminates whether the mounted unit is a genuine article or any one other than the genuine article on the basis of the consumption of the unit or destination information (information such as a country code that specifies a region, where the unit is to be used) of the unit.

According to the selective operation of an operation mode which is accepted by the input unit 502, the mode determination unit 506 set an operation mode which is selected by an user. More particularly, the mode determination unit 506 writes the operation mode selected by the user in the individual operation mode histories 270, thereby setting the operation mode.

Meanwhile, the mode determination unit 506 may automatically switch the operation mode in accordance with the discrimination results of the discriminating unit 504. For example, when any operation mode corresponding to the toner cartridge other than a genuine article is set, if it is discriminated that the mounted cartridge 52 is a genuine article, the mode determination unit 506 may switch the operation mode to an operation mode corresponding to a genuine toner cartridge.

The message output unit 508 outputs a message to a user on the basis of the discrimination results of the discriminating unit 504. The message may be displayed on, for example, the UI device 18 via the UI control circuit 212 (FIG. 12), or may be displayed as a pop-up message or an electronic mail on the host apparatus 2 via the communication I/F circuit 210.

For example, when the discriminating unit 504 discriminates that the mounted unit is unknown, the message output unit 508 makes a confirmation request message that requests a supervisor to confirm whether the unit is a genuine article or any one other than the genuine article, and then transmits the message to the host apparatus 2 for the supervisor.

Further, the message output unit 508 makes a mode confirmation message that urges a user to confirm or switch the operation mode on the basis of the discrimination results by the discriminating unit 504 and the set operation mode, and notifies a user of the made mode confirmation message.

For example, if the discriminating unit 504 discriminates that a mounted unit is a genuine article and an operation mode corresponding to any one other than a genuine article is set, the message output unit 508 displays on the UI device 18 a mode confirmation message that urges the user to switch the current operation mode to an operation mode corresponding to the genuine unit, or a mode confirmation message notifying the user of what the mounted unit is genuine. Further, if the discriminating unit 504 discriminates that a mounted unit is any one other than a genuine article and an operation mode corresponding to a genuine article is set, the message output unit 508 displays on the UI device 18 a mode confirmation message that urges the user to switch the current operation mode to an operation mode corresponding to any one other a genuine unit, or a mode confirmation message notifying the user of what the mounted unit is any one other than a genuine article.

When image forming signals are transmitted to the image forming apparatus 10 constructed as above, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at its development position by the developer container unit 44. In the developer container unit 44, the developer containers 48*a* to 48*d* are respectively supplied with yellow, magenta, cyan and black toners from the toner cartridges 52*a* to 52*d*. Further, toners excessively supplied to the developer containers 48*a* to 48*d* are respectively collected into the toner cartridges 52*a* to 52*d*. Toner images developed for each color by the developer containers 48*a* to 48*d* of the developer container unit 44 are superposed on the intermediate transfer body 74 to be primarily transferred thereto. At the time of the primary transfer, a waste toner remaining on the image carrier 54 is scraped and collected by the cleaner 62 for an image carrier.

On the other hand, upon receiving sheet feeding signals or the like, sheets received in the sheet feeding cassette 24 are fed by the feeding roller 26, are separated by the retard roller 28, and are guided to the conveying path 34, are then primarily stopped by the resist roller 38, and are guided to between the secondary transfer roller 88 and the secondary transfer backup roller 82 at a predetermined timing. When the sheet is guided to between the secondary transfer roller 88 and the secondary transfer backup roller 82, a toner image on which four colors overlap each other by the primary transfer onto the intermediate transfer body 74 is secondarily transferred on the sheet by the secondary transfer roller 88 and the secondary transfer backup roller 82. After the secondary transfer, a waste toner remaining on the intermediate transfer body 74 is scraped by the cleaner 92 for an intermediate transfer body, and is then collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40. The control unit 106 makes a life count value or the like of the toner cartridge 52 stored in the unit NVM 184 and the main body NVM 228.

Next, the control of the image forming apparatus 10 based on the data stored in the storage unit 204 and the unit NVM 184 will now be described.

Meanwhile, setting m1 in this embodiment corresponds to a 'mode A' as an operation mode corresponding to a toner other than a genuine toner. If the mode A is set, the image forming apparatus 10 forms an image while the setting m1 is applied thereto. Similarly, setting m2 corresponds to a 'mode B' as an operation mode corresponding to any one other than a genuine article, setting m3 corresponds to a 'mode C' as an operation mode corresponding to any one other than a genuine article, setting m4 corresponds to a 'mode D' as an operation mode corresponding to any one other than a genuine article, and setting m5 corresponds to a 'mode E' as an operation mode corresponding to any one other than a genuine article. In other words, the image forming apparatus 10 has a plurality of previously set operation modes having corrected amounts different from each other in an image forming process for any one other than a genuine article (toner cartridge). Further, an operation mode corresponding to any one other than a genuine article preferably includes a mode (safe mode) which hardly has bad effects (contamination within the apparatus caused by a toner, or the like) on the image forming apparatus 10, as compared to a 'default mode S' which is set on the assumption that the performance of a genuine article is known.

On the basis of the data stored in the storage unit 204 and the unit NVM 184, the image forming apparatus 10 controls display or the like by the UI device 18. For example, if the toner cartridge 52 is genuine, the residual quantity of the toner is displayed on the UI device 18, whereas if the toner cartridge 52 is not genuine, the consumption of the toner is displayed on the UI device 18.

Next, the discrimination of a unit based on the data stored in the storage unit 204 and the unit NVM 184 and the output of a message based on the discrimination results will be described.

Figure 25:
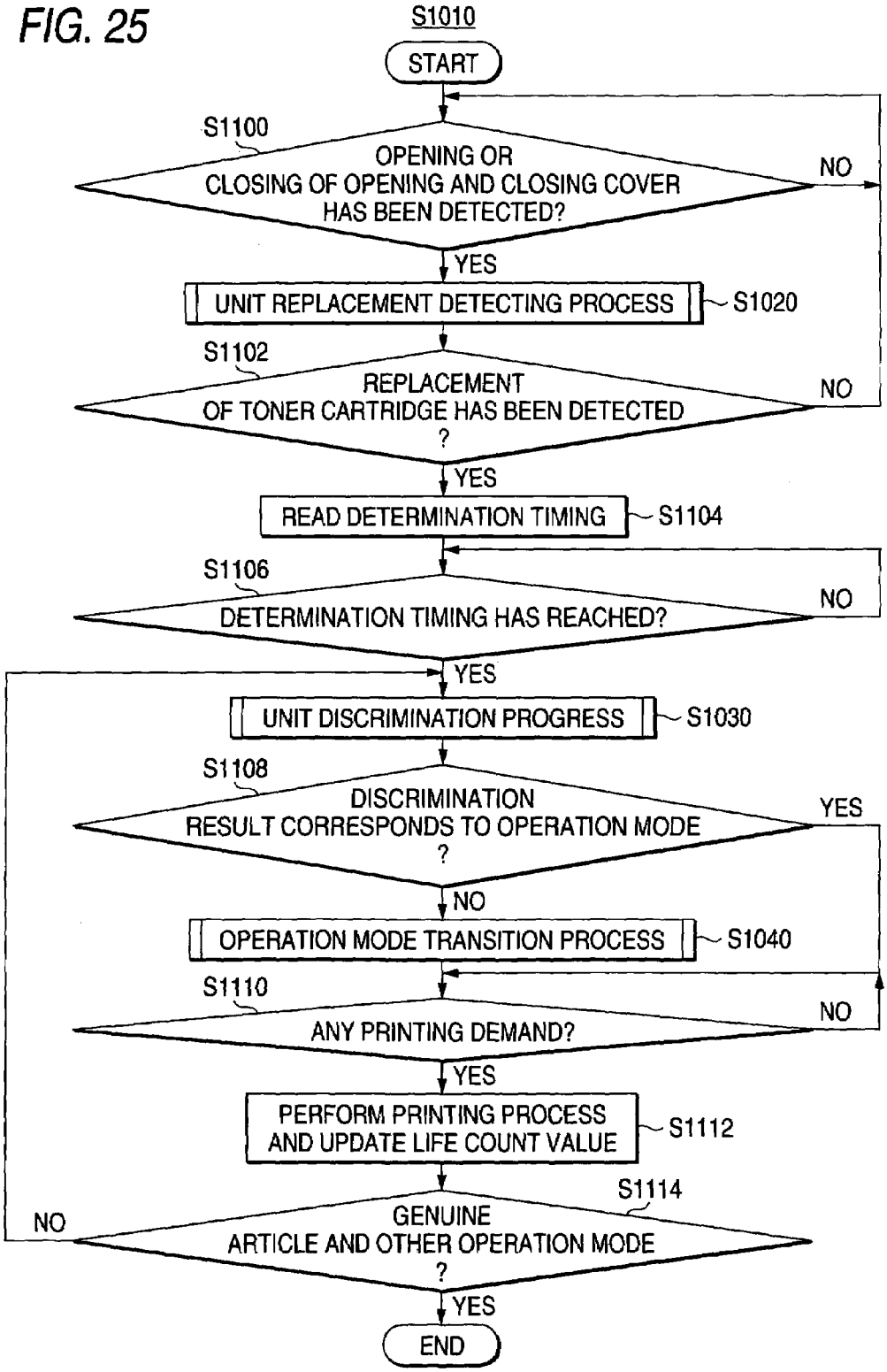
FIG. 25 is a flowchart showing an operation (S1010) of unit discrimination and message output.

FIG. 25 is a flowchart (S1010) of the discrimination of a unit and massage output operation. Meanwhile, this flowchart exemplifies the toner cartridge 52 a specific example of a replaceable unit.

In Step 1100 (S1100), the CPU 202) determines whether or not the opening and closing detecting sensor 19 has detected opening or closing of the opening and closing cover 16. If the CPU 202 determines that the opening or closing of the opening and closing cover 16 has been detected, a process in S1020 is carried out. If not, a process in S1100 is carried out. In other words, if the opening and closing cover 16 is opened or closed, since there is a possibility that the toner cartridge 52 has been replaced, a unit replacement detecting process is carried out.

In Step 1020 (S1020), the CPU 202 detects whether or not a unit has been replaced.

In Step 1102 (S1102), if the CPU 202 considers that the replacement of the toner cartridge 52 has been detected, a process in S1104 is carried out. If not, the process returns to S1100. In other words, for example, when the toner cartridge 52 has been removed once and has once again been mounted as it is, the image forming apparatus 10 considers that the toner cartridge 52 is not replaced, and continues to monitor replacement of the toner cartridge 52.

In Step 1104 (S1104), the CPU 202 reads the determination timing set values 252 from the program ROM 224.

Meanwhile, the determination timing set values 252 may be zero.

In Step 1106 (S1106), the CPU 202 determines whether or not a determination timing has reached that starts to determine whether or not a mounted toner cartridge 52 is genuine, using a timer or the like, which is not shown. If the determination timing has reached that starts to determine whether or not the mounted toner cartridge 52 is genuine, a process in S1030 is carried out. If not, the CPU 202 waits to the determination timing.

In Step 1030 (S1030), the CPU 202 (particularly, the discriminating unit 504 in FIG. 24) discriminates whether or not a mounted toner cartridge 52 is genuine on the basis of information read from the unit NVM 184.

In Step 1108 (S1108), the CPU 202 determines whether or not a currently set operation mode corresponds to a discrimination result (the toner cartridge is a genuine article or any one other than a genuine article) on the toner cartridge 52. If the operation mode does not correspond to the discrimination result (in other words, if the default mode S is set and it is discriminated that the toner cartridge is not genuine, or if any one of the modes A to E is set and it is discriminated that the toner cartridge is genuine), a process in S1040 is carried out. On the other hand, if the operation mode corresponds to the discrimination result (in other words, if the default mode S is set and it is discriminated that the toner cartridge is genuine, or if any one of the modes A to E is set and the toner cartridge is not genuine), a process S1110 is carried out.

In Step 1040 (S1040), the CPU 202 (particularly, the message output unit 508) displays on the UI device 18 a mode confirmation message which urges a user to switch a current operation mode to other operation mode.

Further, if the CPU 202 (particularly, the input unit 502) accepts user's selective operation of an operation mode, the CPU 202 (particularly, the mode determination unit 506) switches the current operation mode to an operation mode selected by the user.

In Step 1110 (S1110), the CPU 202 performs printing preparation in a set operation mode, and waits till a user demands printing. If the user demands printing, a process in S1112 is carried out, and if not, the CPU 202 waits until the user demands printing.

In Step 1112 (S1112), the CPU 202 performs printing process in cooperation with the process control circuit 216 or the like, in response to the printing demand from the user. Further, the CPU 202 adds the consumption of a toner cartridge accompanied with the printing process to the life count values of the toner cartridge 52 stored in the unit NVM 184 and the main body NVM 228, and updates the stored life count values.

In Step 1114 (S1114), if a mounted toner cartridge 52 is genuine and any one of the modes A to E (an operation mode corresponding to any one other than a genuine article) is set, or if the toner cartridge 52 has been replaced, the CPU 202 completes the process (S1010). If not, the process returns to S1030. In other words, if the life count values are updated with the printing process, the image forming apparatus 10 carries out again the discrimination process (S1030) of a unit on the basis of the updated life count values to urge a user to select an appropriate operation mode.

Figure 26:
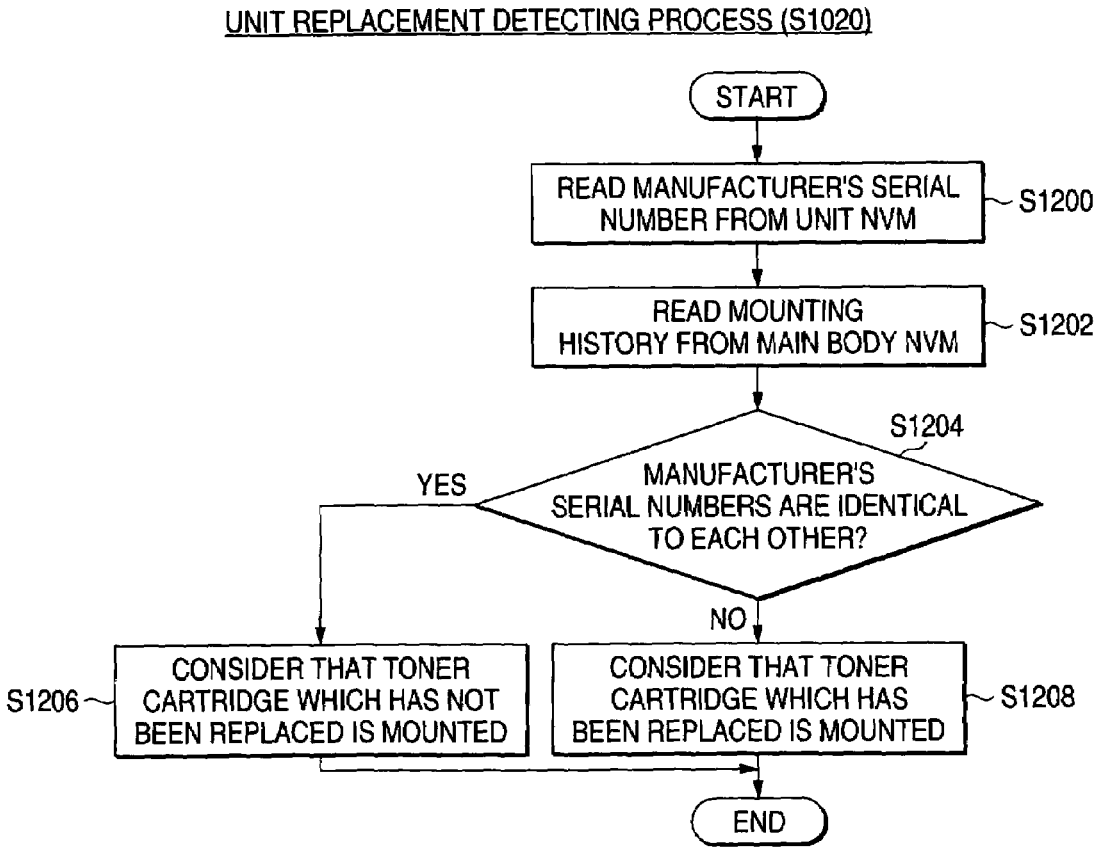
FIG. 26 is a flowchart for explaining a unit replacement detecting process (S1020) shown in FIG. 25 in more detail.

FIG. 26 is a flowchart for explaining a unit replacement detecting process (S1020) shown in FIG. 25 in more detail.

Figure 27:
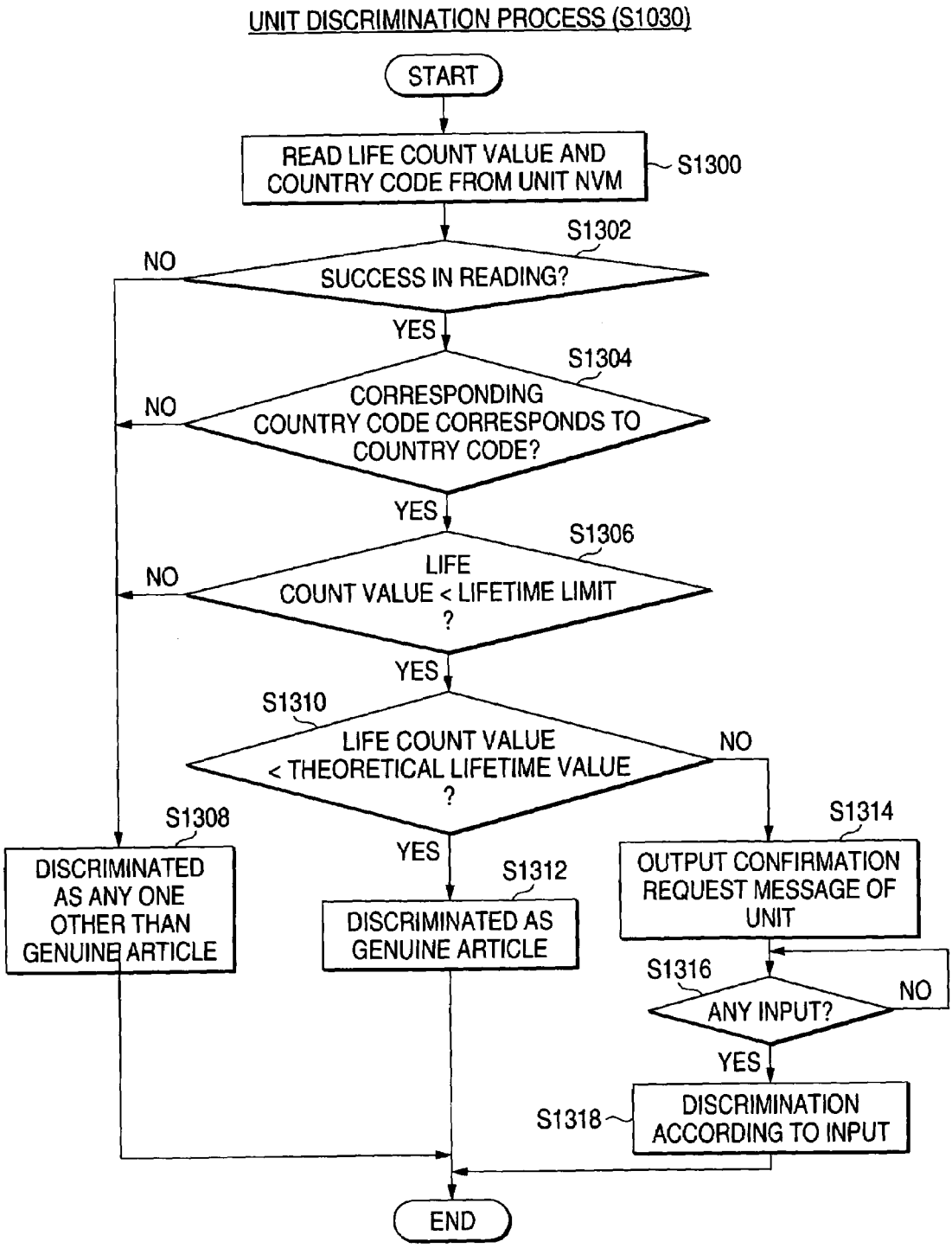
FIG. 27 is a flowchart for explaining a unit discriminating process (S1030) shown in FIG. 25 in more detail.

FIG. 27 is a flowchart for explaining a unit discriminating process (S1030) shown in FIG. 25 in more detail.

Figure 28:
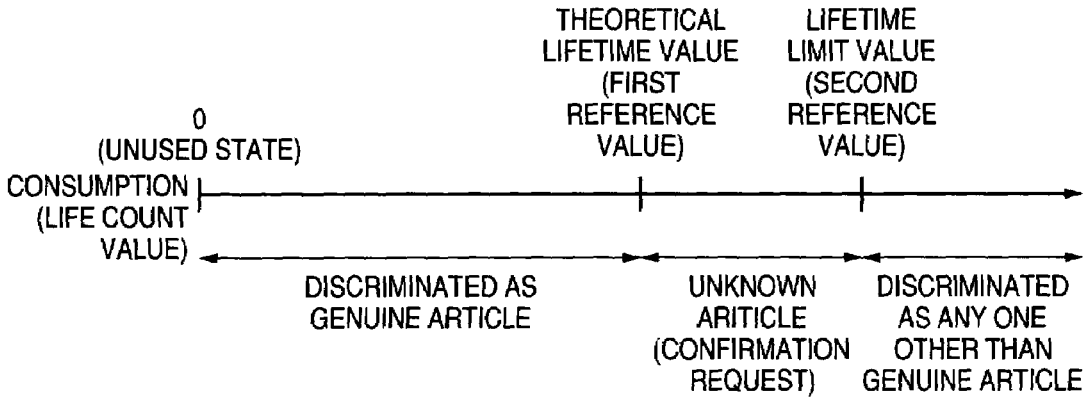
FIG. 28 illustrates the relationship between a theoretical lifetime value or a lifetime limit referred to in the unit discriminating process (S1030), and discrimination results.

FIG. 28 illustrates the relationship between a theoretical lifetime value or a lifetime limit referred to in the unit discriminating process (S1030), and discrimination results.

In Step 1300 (S1300), the CPU 202 (particularly, the determination unit 504) tries reading of a life count value 288 and a country code 278 from the unit NVM 184.

In Step 1302 (S1302), the CPU 202 tries reading of the life count value 288 and the country code 278 by preset times. If the CPU 202 succeeds in the reading, a process in S1304 is carried out. If the CPU 202 completely fails in the reading, a process in S1308 is carried out. In other words, if the image forming apparatus 10 cannot achieve normal communication with the toner cartridge 52, it is discriminated that the toner cartridge 52 is not genuine.

In Step 1304 (S1304), the CPU 202 (particularly, the discriminating unit 504) reads a corresponding country code 260 from the main body NVM 228, and compares the read country code 260 with a country code 278 read from the unit NVM 184. As a result, if the corresponding country code 260 corresponds to the country code 278, a process in S1306 is carried out. If the corresponding country code 260 does not correspond to the country code 278, the process in S1308 is carried out. In other words, if the destination of the toner cartridge 52 is not right, the image forming apparatus 10 discriminates that the toner cartridge is not genuine.

In Step 1306 (S1306), the CPU 202 (particularly, the discriminating unit 504) reads a lifetime limit (included in the individual lifetime threshold values 240) of the toner cartridge from the program ROM 224, and compares the read lifetime limit with a life count value read from the unit NVM 184. As a result, if the life count value is more than the lifetime limit, the process in S1308 is carried out. If the life count value is smaller than the lifetime limit, a process S1310 is carried out. In other words, if the cumulative consumption of the toner cartridge 52 is more than the lifetime limit shown in FIG. 28, it is most unlikely that a genuine toner cartridge 52 has such cumulative consumption. Therefore, the image forming apparatus 10 considers such a toner cartridge as a toner cartridge other than a genuine article, such as a toner cartridge refilled with a toner, and thus discriminates that the toner cartridge 52 is not genuine.

In Step 1308 (S1308), the CPU 202 discriminates the toner cartridge 52 is not genuine.

In Step 1310 (S1310), the CPU 202 (particularly, the discriminating unit 504) reads a theoretical lifetime value (included in the individual lifetime threshold values 240) of a toner cartridge from the program ROM 224, and compares the read theoretical lifetime value with a life count value read from the unit NVM 184. As a result, if the life count value is smaller than the theoretical lifetime value, a process in S1312 is carried out. If the life count value is more than the theoretical lifetime value, a process in S1314.

In Step 1312 (S1312), the CPU 202 discriminates that the toner cartridge 52 is genuine. In other words, if the cumulative consumption of the toner cartridge 52 is smaller than the theoretical lifetime value shown in FIG. 28, since the cumulative consumption is in a range of values (normal values) which can be acquired by a genuine toner cartridge 52, the image forming apparatus 10 discriminates that the toner cartridge 52 is genuine.

Figure 30:
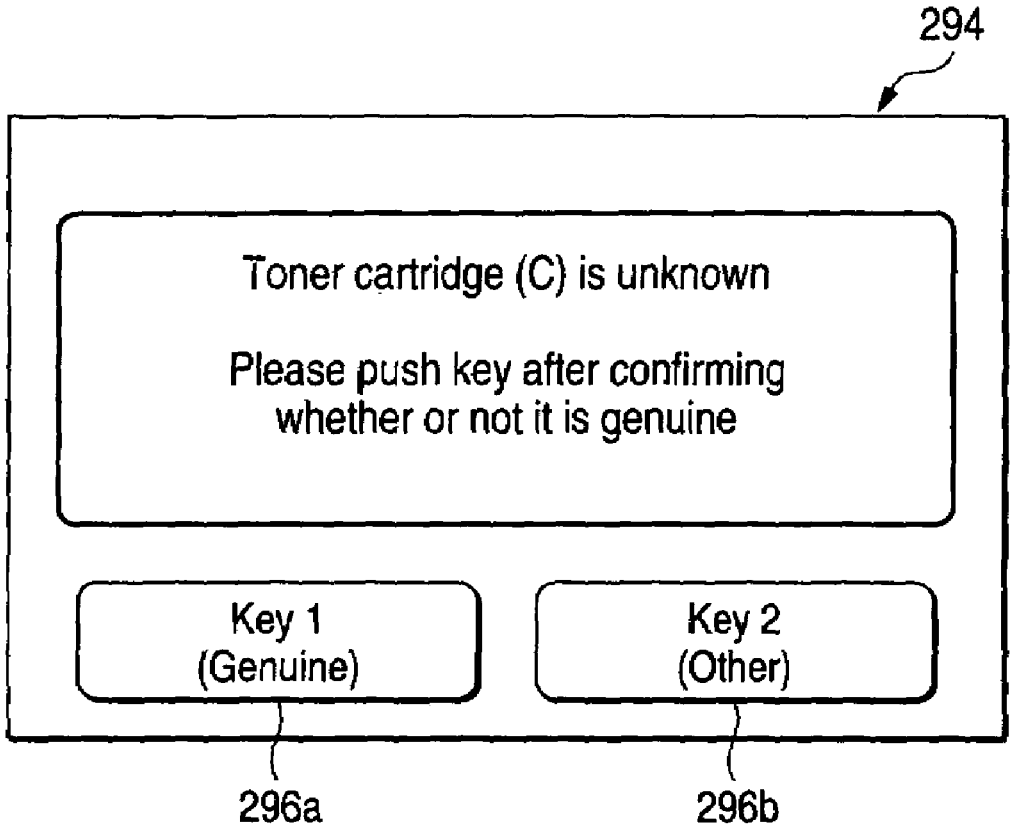
FIG. 30 illustrates a screen 294 on which a confirmation request message that urges a user to input whether or not a toner cartridge is genuine is displayed.

In Step 1314 (S1314), the CPU 202 (particularly, the message output unit 508) makes a confirmation request message which urges a user to input whether or not the toner cartridge 52 is genuine, and then transmits the message to the host apparatus 2 for a supervisor. The host apparatus 2 displays a confirmation request message as illustrated in FIG. 30 on a screen 297 of a monitor to urge the user a response to the confirmation request massage. Meanwhile, as illustrated in FIG. 30, along with the confirmation request message, a key button 296*a* for inputting what a toner cartridge is genuine, a key button 296*b* for inputting what a toner cartridge is not genuine, and the like are displayed on the screen 294.

In Step 1316 (S1316), the CPU 202 (particularly, the input unit 502) accepts an input operation (a response to the confirmation request message) for selecting whether or not the toner cartridge 52 is genuine. If the input operation is accepted, a process in S1318 is carried out. If not, the CPU 202 waits till an input operation.

In Step 1318 (S1318), the CPU 202 (particularly, the determination unit 504) discriminates that the toner cartridge 52 is a genuine article or any one other than a genuine article according to a response (input operation) to the confirmation request message from a supervisor. In other words, if a life count value is between a theoretical lifetime value and a lifetime limit, the image forming apparatus 10 asks a question to a supervisor and then discriminates whether or not the toner cartridge 52 is genuine according to a response from the supervisor.

Figure 29:
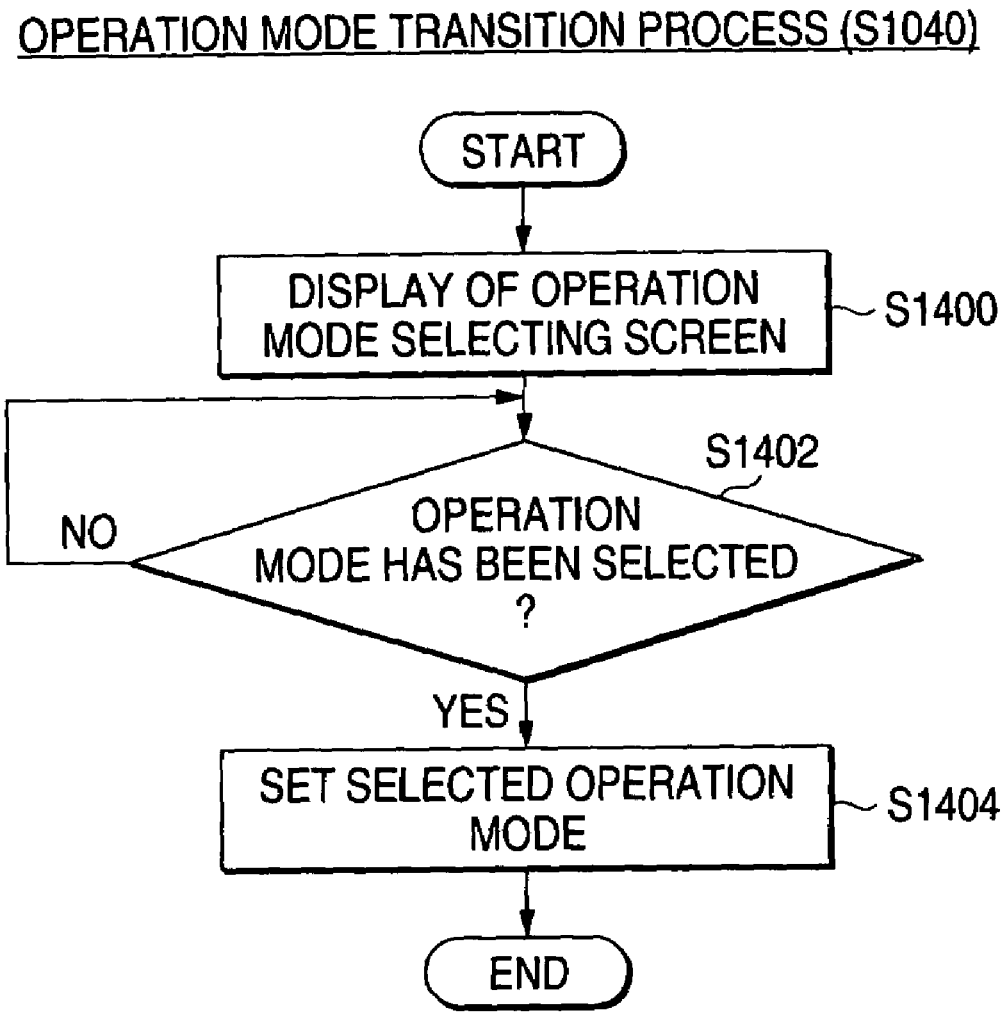
FIG. 29 is a flowchart for explaining an operation mode transition process (S1040) shown in FIG. 25 in more detail.

FIG. 29 is a flowchart for explaining an operation mode transition process (S1040) shown in FIG. 25 in more detail.

Figure 31A:
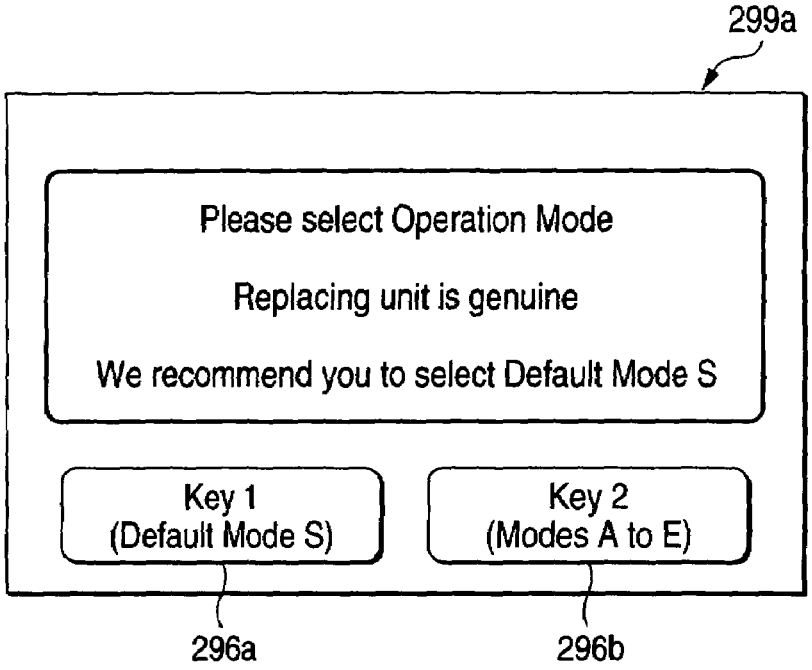
Figure 31B:
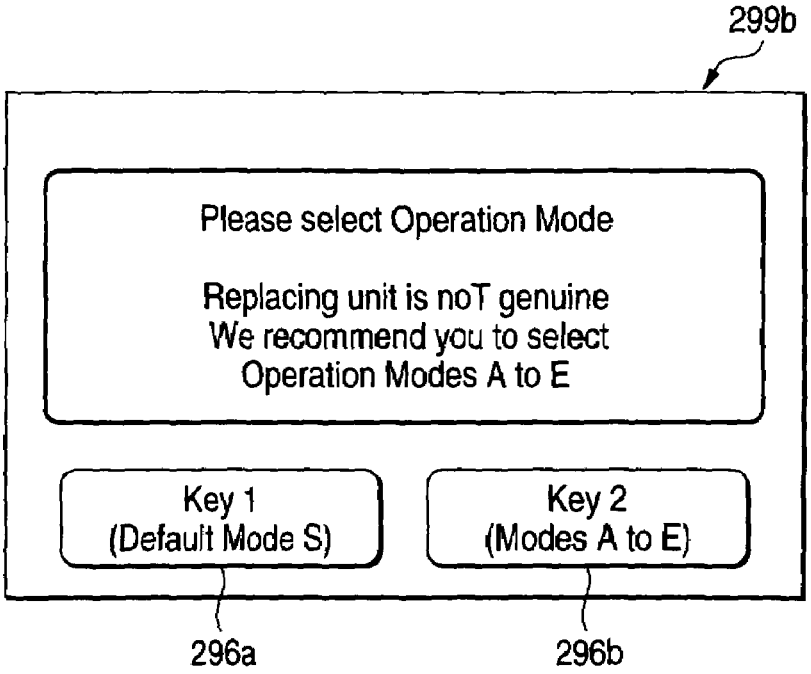
FIG. 31B is an operation mode selecting screen 299*b* when a toner cartridge other than a genuine article is mounted.

In Step 1400 (S1400), the CPU 202 (particularly, the message output unit 508) instructs the UI device 18 to display a mode confirmation message according to a discrimination result on a toner cartridge. In accordance with the instruction, the UI device 18 displays an operation mode selecting screen 299 in which a mode confirmation message according to whether or not the toner cartridge is genuine is included, as illustrated in FIGS. 31A and 31B. Specifically, if a mounted toner cartridge 52 is genuine, the UI device 18 displays an operation mode selecting screen 299*a* shown in FIG. 31A, and if the mounted toner cartridge 52 is not genuine, displays an operation mode selecting screen 299*b* shown in FIG. 31B. The key button 296*a* for selecting the default mode S (operation mode corresponding to a genuine article), the key button 296*b* for selecting other operation mode (operation mode corresponding to any one other than a genuine article), a message notifying a user of what a mounted toner cartridge is genuine and a message notifying the user of what it is preferable to select the default mode S are displayed on the operation mode selecting screen 299*a*. Key buttons 296*a* and 296*b* similar to the above, and a message notifying a user of what it is preferable to other operation mode (any one of the modes A to E), if the mounted toner cartridge is not genuine, are displayed on the operation mode selecting screen 299*b* corresponding to any one other than a genuine article. Meanwhile, the modes A to E can be selected by continuously pushing the key button 296*b*.

In Step 1402 (S1402), the CPU 202 (particularly, the input unit 502) discriminates whether the input of selecting either the key button 296*a* or the key button 296*b* displayed on the operation mode selecting screen 299*a* (or operation mode selecting screen 299*b*) has been completed. If the input of selecting any one of the key buttons 296*a* and 296*b* is performed in a preset period of time, a process in S1404 is carried out. If the input of specifying any one of the operation modes was not performed in a preset period of time, the operation mode transition process (S1040) is completed without switching a current operation mode.

In Step 1404 (S1404), the CPU 202 (particularly, the mode determination unit 506) updates (including overwrite) the individual operation mode histories 270 of the main body NVM 228 with an operation mode selected in S1402. In other words, the CPU 202 updates the individual operation mode histories 270 of the main body NVM 228 according to a user's input, and then sets an operation mode selected by the user.

As described above, the image forming apparatus 10 in the present embodiment discriminates whether or not a unit is genuine, and then suggests that a user switches a current operation mode to other operation mode according to the discrimination results. As a result, a user can set an operation mode corresponding to a unit, and deterioration of image quality and failure of the image forming apparatus caused by incompatibility between the unit and the operation mode can be prevented beforehand. In particular, since a user is notified of a discrimination result (a unit is a genuine article, any one other than a genuine article, or an unknown article) on a unit, and a plurality of choices (a plurality of operation modes) is prepared, it is possible to select an operation mode which is considered most suitable by a user's intention.

Further, since the image forming apparatus 10 discriminates whether or not a unit is genuine on the basis of the consumption of the unit, for example, even when a genuine toner cartridge has been refilled with a toner, the image forming apparatus can discriminate that the toner cartridge is not genuine.

Meanwhile, in the flowchart (FIG. 29) of the above operation mode transition process (S1040), the image forming apparatus 10 switches a current operation mode to other operation mode according to a user's selection. However, the present invention is not limited thereto, and a current operation mode may be automatically switched to an operation mode according to a discrimination result on a unit. In other words, if it is discriminated that a toner cartridge 52 is genuine, and an operation mode (any one of operation modes (the modes A to E) corresponding to any one other than a genuine article) is set, the image forming apparatus 10 may switch a current operation mode to an operation mode (default mode S) corresponding to a genuine article regardless of user's choice. As a result, it is possible to make the performance of units exhibited to the maximum by switching a current operation mode to other most appropriate operation mode according to discrimination results.

What is claimed is:

1. An image forming apparatus comprising:

an image forming apparatus main body;

at least one replaceable unit replaceably mounted in the image forming apparatus main body;

a detecting unit that detects whether or not the replaceable unit has been replaced;

an input unit that allows a user to select an operation mode from the group including a first operation mode corresponding to the replaceable unit which is genuine and a second operation mode other than the first operation mode; and a control unit, wherein:

when the detecting unit detects that the replaceable unit has been replaced, the control unit controls the image forming apparatus to operate in an operation mode, in which the image forming apparatus operated before the replaceable unit was replaced, for a predetermined period of time from the time when the detecting unit detects that the replaceable unit has been replaced, and then the control unit controls the image forming apparatus to operate in the selected first or second operation mode.

2. An image forming apparatus comprising:

an image forming apparatus main body;

at least one replaceable unit replaceably mounted in the image forming apparatus main body;

a detecting unit that detects whether or not the replaceable unit has been replaced;

a discriminating unit that discriminates whether or not the replaceable unit is genuine;

an input unit that allows a user to select an operation mode from the group including a first operation mode corresponding to the replaceable unit which is genuine and a second operation mode other than the first operation mode; and a control unit, wherein:

when the detecting unit detects on the basis of discrimination results of the discriminating unit that the replaceable unit has been replaced, the control unit controls the image forming apparatus to operate in an operation mode, in which the image forming apparatus operated before the replaceable unit was replaced, for a predetermined period of time from the time when the detecting unit detects that the replaceable unit has been replaced, and then the control unit controls the image forming apparatus to operate in the selected first or second operation mode.

3. The image forming apparatus according to claim 2, further comprising:

a storage unit that stores an applied operation mode, wherein:

when the detecting unit detects that the replaceable unit has been replaced, the discriminating unit discriminates that the replaceable unit is not genuine, and the selected first or second operation mode is different from the operation mode stored in the storage unit, the control unit controls the image forming apparatus to operate in the first operation mode for the predetermined period of time from the time when the replaceable unit was replaced.

4. The image forming apparatus according to claim 2, further comprising:

a storage unit that stores an applied operation mode, wherein:

the detecting unit detects that the replaceable unit has been replaced, the discriminating unit discriminates that the replaceable unit is genuine, and the selected first or second operation mode is different from the operation mode stored in the storage unit, the control unit controls the image forming apparatus to operate in the second operation mode for the predetermined period of time from the time when the replaceable unit was replaced.

5. An image forming apparatus comprising:

an image forming apparatus main body;

at least one toner cartridge unit replaceably mounted in the image forming apparatus main body;

a developer container connected to the toner cartridge;

a detecting unit that detects whether or not the toner cartridge has been replaced;

an input unit that allows a user to select an operation mode from the group including a first operation mode corresponding to the toner cartridge which is genuine and a second operation mode other than the first operation mode; and a control unit, wherein:

when the detecting unit detects that the toner cartridge has been replaced, the control unit controls the image forming apparatus to operate in an operation mode, in which the image forming apparatus operated before the replaceable unit was replaced, for a predetermined period of time from the time when the detecting unit detects that the toner cartridge has been replaced, and then the control unit controls the image forming apparatus to operate in the selected first or second operation mode.

6. An image forming apparatus comprising:

an image forming apparatus main body;

at least one replaceable unit replaceably mounted in the image forming apparatus main body;

a storage unit provided in the replaceable unit for storing information on a consumption of the replaceable unit, a discriminating unit that discriminates whether or not the replaceable unit is genuine on the basis of the information on the consumption read from the storage unit;

a message output unit that outputs a message according to a discrimination result by the discriminating unit, an input unit that allows a user to select any one of a first operation mode corresponding to the replaceable unit which is genuine and other operation modes than the first operation mode; and a control unit, wherein:

the discriminating unit determines a cumulative consumption of the replaceable unit on the basis of the information on the consumption read from the storage unit, and if the determined cumulative consumption is between a first reference value that indicates the replaceable unit needs to be replaced and that indicates the replaceable unit is genuine and a second reference value which is greater than that the first reference value, the discriminating unit discriminates that the replaceable unit is genuine.

7. The image forming apparatus according to claim 6, wherein:

the storage unit stores the information on the consumption of the replaceable unit and information indicating a destination of the replaceable unit, and the discriminating unit discriminates whether or not the replaceable unit is genuine, on the basis of the information on the consumption and the information indicating the destination of the replaceable unit, which are read from the storage unit.

8. The image forming apparatus according to claim 6, wherein:

the second reference value is a cumulative consumption at which the genuine replaceable unit cannot be used, the discriminating unit determines the cumulative consumption of the replaceable unit on the basis of the read information on the consumption, and if the determined cumulative consumption exceeds the second reference value, the discriminating unit discriminates that the replaceable unit is not genuine.

9. The image forming apparatus according to claim 6, wherein:

the discriminating unit determines the cumulative consumption of the replaceable unit on the basis of the read information on the consumption, and if the determined cumulative consumption is smaller than the first reference value, the discriminating unit discriminates that the replaceable unit is genuine.

10. The image forming apparatus according to claim 8, wherein:

if the cumulative consumption determined on the basis of the information on the consumption read from the storage unit is between the first reference value and the second reference value, the message output unit outputs a message that urges a user to input whether or not the replaceable unit is genuine, and the control unit switches a current operation mode to another operation mode according to a response to the message.

11. The image forming apparatus according to claim 6, wherein the discriminating unit determines the cumulative consumption of the replaceable unit, on the basis of the information on the consumption of the replaceable unit read from the storage unit and a consumption of the replaceable unit to be used during an image forming process.

12. An image forming apparatus comprising:

an image forming apparatus main body;

at least one replaceable unit replaceably mounted in the image forming apparatus main body;

a storage unit provided in the replaceable unit for storing information on a consumption of the replaceable unit;

a discriminating unit that discriminates whether or not the replaceable unit is genuine on the basis of the information on the consumption read from the storage unit, a first reference value that indicates the replaceable unit needs to be replaced, and a second reference value which is greater than the first reference value; and a control unit that performs control in a first operation mode corresponding to the replaceable unit which is genuine or in an operation mode other than the first operation mode, based on the discrimination result by the discriminating unit, wherein:

if the other operation mode is set and a cumulative consumption of the replaceable unit determined on the basis of the information on the consumption is between the first reference value and the second reference value, the control unit switches the other operation mode to the first operation mode.

13. A method of controlling an image forming apparatus in which at least one replaceable unit is mounted in an image forming apparatus main body, the method comprising:

reading information on a consumption of the replaceable unit from a memory provided in the replaceable unit;

determining a cumulative consumption of the replaceable unit on the basis of the read information on the consumption; and if the determined cumulative consumption is between a first reference value that indicates the replaceable unit needs to be replaced and a second reference value which is greater than the first reference value, and an operation mode corresponding to the replaceable unit which is not genuine is set, switching the set operation mode to an operation mode corresponding to the replaceable unit which is genuine.

14. A method of controlling an image forming apparatus in which at least one replaceable unit is mounted in an image forming apparatus main body, the method comprising:

reading information on a consumption of the replaceable unit from a memory provided in the replaceable unit;

determining a cumulative consumption of the replaceable unit on the basis of the read information on the consumption; and if the determined cumulative consumption is between a first reference value that indicates the replaceable unit needs to be replaced and a second reference value which is greater than the first reference value, and an operation mode corresponding to the replaceable unit which is not genuine is set, outputting a message notifying a user that an operation mode corresponding to the replaceable unit which is genuine can be applied or a message notifying the user that the mounted replaceable unit is genuine.

* * * * *